US012741189B2

(12) United States Patent
Mullenbach et al.

(10) Patent No.: US 12,741,189 B2
(45) Date of Patent: Sep. 22, 2026

(54) PORTABLE COURT SYSTEM FOR MULTIPLAYER PADDLE-AND-BALL GAMEPLAY WITH ADJUSTABLE SECTION BOUNDARIES

(71) Applicant: Topsail Sunrise Company LLC, Suwanee, GA (US)

(72) Inventors: Brian Mullenbach, Suwanee, GA (US); Chris Kwiat, Charlotte, NC (US); Mary Mullenbach, Suwanee, GA (US); Mary Elizabeth Kwiat, Charlotte, NC (US)

(73) Assignee: Topsail Sunrise Company LLC, Suwanee, GA (US)

( * ) Notice: Subject to any disclaimer, the term of this patent is extended or adjusted under 35 U.S.C. 154(b) by 0 days.

(21) Appl. No.: 19/536,373

(22) Filed: Feb. 11, 2026

(65) Prior Publication Data

US 2026/0249155 A1 Aug. 27, 2026

Related U.S. Application Data

(60) Provisional application No. 63/762,369, filed on Feb. 24, 2025.

(51) Int. Cl.
*A63B 71/02* (2006.01)

(52) U.S. Cl.
CPC ..... *A63B 71/02* (2013.01)

(58) Field of Classification Search
CPC ..... A63B 61/00; A63B 61/003; A63B 61/02; A63B 61/04; A63B 67/002; A63B 2067/005; A63B 2102/08; A63B 71/02; A63B 71/021; A63B 71/04
See application file for complete search history.

(56) References Cited

U.S. PATENT DOCUMENTS 2,366,782 A * 1/1945 Gorsuch ..... A63B 67/002 D21/457
3,452,985 A * 7/1969 Zmura ..... A63B 67/04 473/475
4,108,434 A * 8/1978 Royer ..... A63B 67/04 473/475
D254,018 S * 1/1980 Malm ..... D21/301
(Continued)

FOREIGN PATENT DOCUMENTS

WO WO-2009047717 A2 * 4/2009 ..... A63B 67/002

*Primary Examiner* — Christopher R Legendre
(74) *Attorney, Agent, or Firm* — H. Brock Kolls

(57) ABSTRACT

A reconfigurable paddle ball court system for a multiplayer paddle-and-ball game. The system includes a rigid outer frame defining an outer boundary of a playing court, an inner hub within the outer boundary, inner fasteners distributed about a perimeter region of the inner hub, and divider cords. Each divider cord has a first end removably coupleable to a selected inner fastener and a second end removably coupleable to the rigid outer frame at a selectable attachment location, such as by a snap clip. The divider cords can be elastically tensioned to remain taut and define visually determinable internal boundaries that form multiple playing sections. During gameplay, one or more divider cords can be detached and reattached to change the number and/or the size of the playing sections while the rigid outer frame remains assembled and deployed.

20 Claims, 10 Drawing Sheets

(56) References Cited

U.S. PATENT DOCUMENTS

| | | | | | |
|---|---|---|---|---|---|
| 4,335,877 | A * | 6/1982 | Long | A63B 67/04 | 473/475 |
| 4,522,395 | A * | 6/1985 | Arndt | A63B 67/04 | 473/475 |
| 5,674,139 | A * | 10/1997 | Brooks | A63B 67/002 | 473/473 |
| 7,311,617 | B2 * | 12/2007 | Langhorn | A63B 63/00 | 273/400 |
| 7,488,264 | B2 * | 2/2009 | Seaman | A63B 69/0071 | 473/433 |
| 7,637,827 | B2 * | 12/2009 | Bangerter | A47B 25/003 | 473/496 |
| 9,283,491 | B2 * | 3/2016 | Pope-Gusev | A63H 33/008 | |
| 11,192,009 | B1 * | 12/2021 | Saphire | A63B 61/003 | |
| 2014/0179466 | A1 * | 6/2014 | Myers | A63B 67/002 | 473/476 |
| 2014/0370996 | A1 * | 12/2014 | Piccolo | A63B 67/002 | 472/94 |
| 2020/0054927 | A1 * | 2/2020 | Ralli | A63C 19/065 | |
| 2021/0062535 | A1 * | 3/2021 | Boggess | A63B 69/00 | |
| 2025/0303249 | A1 * | 10/2025 | McClure | A63B 61/003 | |

* cited by examiner

A
B
C
100
114A
202A
116A
116B
116C
116D
102
202B
114B
114C

PORTABLE COURT SYSTEM FOR MULTIPLAYER PADDLE-AND-BALL GAMEPLAY WITH ADJUSTABLE SECTION BOUNDARIES

CROSS-REFERENCE TO RELATED APPLICATIONS

This application contains subject matter which is related to the subject matter of the following application. The below-listed application is hereby incorporated herein by reference in its entirety:

This is a U.S. non-provisional application that claims the benefits of a U.S. provisional application, Ser. No. 63/762,369, inventor Brian Mullenbach, entitled "PADDLE BALL COURT SYSTEM AND GAMEPLAY METHODS", filed Feb. 24, 2025.

TECHNICAL FIELD OF THE INVENTION

This invention relates to recreational and competitive sports game equipment, and particularly to portable, reconfigurable court systems for multiplayer paddle-and-ball gameplay, including boundary structures and divider architectures that enable selective definition and in-game adjustment of a plurality of playing sections.

BACKGROUND OF THE INVENTION

Before our invention, paddle-and-ball games that depended on a defined court and subdivided play areas were generally implemented using prior approaches that were optimized for casual, short-duration recreation rather than repeatable and reliably judgeable court play. In many instances, the "court" was established using whatever boundary elements happened to be available at the location—loose ropes, straps, cords, stakes, cones, or improvised markings—and players would arrange those elements in an approximate shape based on convenience rather than on a standardized geometry. Because such boundary elements were often compliant, lightweight, and unsecured along their length, they could drift or distort over the course of play due to wind, foot traffic, incidental contact, or the natural movement of the underlying surface. As the boundary moved, the effective play area could change without players realizing it, which could turn what should have been a straightforward in-bounds or out-of-bounds call into a judgment call, and those judgment calls could vary from player to player and from point to point.

Prior approaches also frequently struggled with internal sectioning of the court. Even where a perimeter was established, divider elements used to create multiple playing sections were commonly narrow, non-planar, and inconsistently tensioned, which made it difficult to visually locate the true boundary line at speed. A divider that sags, twists, rolls, or migrates laterally can create uncertainty about whether a ball struck the boundary, cleared the boundary, or landed on one side versus the other. That uncertainty can be amplified on uneven outdoor surfaces where a divider can partially bury, lift, or curl, and where a ball may strike the divider at a glancing angle. In addition, divider elements that are not reliably tensioned can entangle, knot, or snag during setup and takedown, slowing deployment and making it hard to keep the game moving once players are ready to play.

Another shortcoming of prior approaches was the lack of repeatability when attempting to recreate a previously used court configuration. When a court layout depends on "eyeballing" placement or on informal spacing, small variations in boundary placement can materially change play dynamics by changing the size or shape of each player's area. That variability can make it difficult to practice, to compare performance across sessions, or to run organized play where consistent geometry is expected. Moreover, when player counts change during a match or session, prior approaches often required a full stop and a cumbersome reset-moving multiple boundary elements, remeasuring, repositioning anchors, or rebuilding the perimeter-causing downtime that interrupts gameplay flow and discourages players from making adjustments even when the situation calls for it.

Prior approaches also tended to provide limited guidance to players during setup. Without clear reference positions or visual cues indicating intended attachment locations, players could spend time debating where boundaries should go, could accidentally create asymmetric or unintended section geometry, or could misconfigure a court in a way that undermines fairness. This becomes more pronounced when different skill levels are involved, because without a practical way to intentionally tailor section size in a controlled and repeatable manner, balancing competitive play can be difficult and often relies on informal "house rules" that do not translate consistently from one setup to another. In addition, prior approaches often failed to integrate transport, storage, and inventory control into the court concept itself, leading to missing components, inconsistent equipment availability, and degraded quality of setup over time due to tangled cords, lost connectors, or damaged boundary elements.

These and other limitations could prevent prior approaches from being reliably used in more structured environments where consistent boundaries, repeatable configurations, and efficient setup are important to maintaining fairness and reducing disputes. The present invention addresses these and other shortcomings by providing a reconfigurable paddle ball court system and gameplay method that defines a plurality of playing sections for a multiplayer paddle-and-ball game. For these reasons and shortcomings, as well as other reasons and shortcomings, there is a long-felt need that gives rise to the present invention.

SUMMARY OF THE INVENTION

The shortcomings of the prior art are overcome, and additional advantages are provided through the provision of a reconfigurable paddle ball court system configured to define a plurality of playing sections for a multiplayer paddle-and-ball game. In an exemplary embodiment, the system can include a rigid outer frame configured, when assembled, to define an outer boundary of a playing court, and an inner hub disposed within the outer boundary. In an exemplary embodiment, a plurality of inner fasteners can be coupled to the inner hub and distributed about a perimeter region of the inner hub, and a plurality of divider cords can be provided to define internal boundaries within the playing court. Each divider cord can have a first end that is removably coupleable to any selected one of the plurality of inner fasteners and a second end that is removably coupleable to the rigid outer frame at a selectable attachment location along the rigid outer frame. In an exemplary embodiment, when coupled between the inner hub and the rigid outer frame, the divider cords can be maintained taut and can cooperatively define a plurality of playing sections arranged circumferentially about the inner hub. In an exemplary embodiment, the divider cords can further be detached and reattached during gameplay to change a number of the playing sections and or a size of at least one playing section while the rigid outer frame remains assembled and deployed.

Additional shortcomings of the prior art are overcome, and additional advantages are provided through the provision of a reconfigurable paddle ball court system configured to define a plurality of playing sections for a multiplayer paddle-and-ball game. In an exemplary embodiment, the system can include a rigid outer frame defining an outer perimeter boundary of a playing court when assembled, and an inner hub positioned within the rigid outer frame. In an exemplary embodiment, a plurality of divider cords can each extend between the inner hub and the rigid outer frame. Each divider cord can include an inner-end connector configured to removably couple to the inner hub at one of a plurality of discrete hub attachment locations, and an outer-end connector comprising a snap clip configured to removably engage the rigid outer frame at any of a plurality of selectable positions along the rigid outer frame. In an exemplary embodiment, each divider cord can be elastically tensioned between the inner hub and the rigid outer frame to reduce distortion of boundary geometry during gameplay and to facilitate the determination of in-bounds and out-of-bounds conditions for the multiplayer paddle-and-ball game while defining the plurality of playing sections.

Additional shortcomings of the prior art are overcome, and additional advantages are provided through the provision of a reconfigurable paddle ball court system configured to define a plurality of playing sections for a multiplayer paddle-and-ball game. In an exemplary embodiment, the system can include a rigid outer frame configured to define an outer boundary of a playing court when assembled and an inner hub disposed within the outer boundary. In an exemplary embodiment, a plurality of inner fasteners can be disposed about a perimeter region of the inner hub, and a plurality of elastically tensioned divider cords can be provided, each having a first end removably coupleable to any selected inner fastener and a second end removably coupleable to the rigid outer frame at a selectable position along the rigid outer frame. In an exemplary embodiment, the multiplayer paddle-and-ball game can be playable under one or more predefined gameplay rules, and the elastically tensioned divider cords can remain taut during gameplay to provide visually determinable boundaries corresponding to the one or more predefined gameplay rules while defining the plurality of playing sections arranged about the inner hub. In an exemplary embodiment, the system can be reconfigured during gameplay, in response to a predefined gameplay condition, by relocating at least one divider cord to change a number of the playing sections and or a relative size of the playing sections without disassembling the rigid outer frame.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawings in which:

Figure 1:
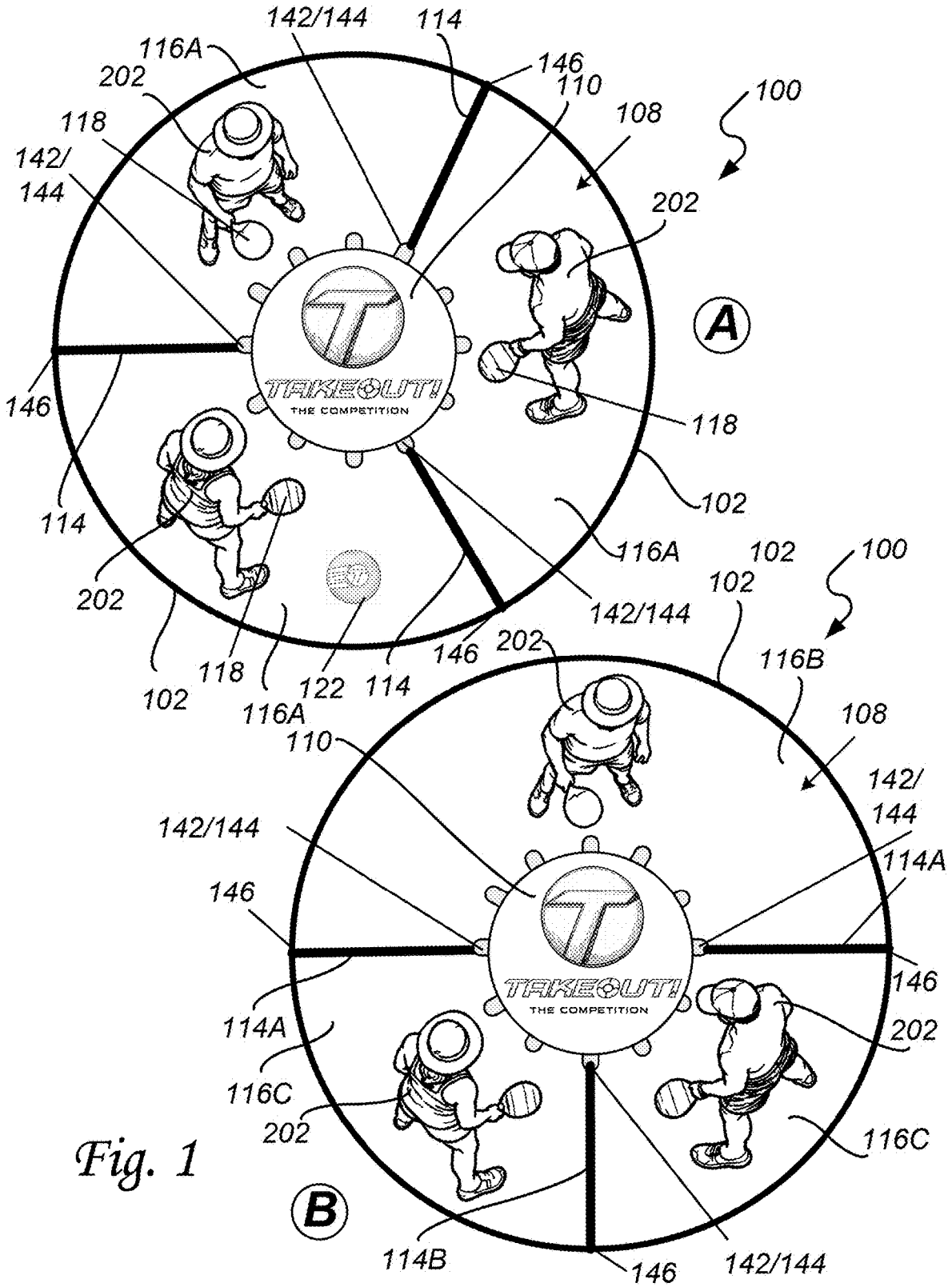
FIGS. 1-2 illustrates one example of a paddleball court system and gameplay method.

The detailed description explains the preferred embodiments of the invention, together with advantages and features, by way of example, with reference to the drawings.

DETAILED DESCRIPTION OF THE INVENTION

Conventional approaches to defining a temporary playing court for a multiplayer paddle-and-ball game are typically optimized for informal, recreational play. Such approaches may be adequate where occasional boundary deformation, ambiguity in boundary calls, and ad hoc adjustment of court layout are acceptable. However, as competitive play becomes more structured, game court requirements tend to place greater emphasis on repeatable court geometry, clear and consistently determinable boundary conditions, and the ability to deploy a court configuration that remains stable over the duration of a match or series of matches. In these contexts, a court boundary that is prone to deformation or displacement can create inconsistent in-bounds and out-of-bounds determinations, interrupt gameplay, and reduce confidence in the integrity of scoring outcomes. Further, a court layout that is effectively fixed can be poorly suited for organized formats in which the number of players changes between points, games, rounds, or heats, because a fixed layout may not efficiently support multiple player counts or standardized play formats without time-consuming teardown and re-setup.

The present invention addresses these shortcomings by providing a reconfigurable paddle ball court system that is configured to maintain a visually determinable court boundary while also enabling rapid and repeatable reconfiguration of internal playing sections during gameplay. In one example, the system includes a rigid outer frame that, when assembled, defines an outer boundary of a playing court. The rigid outer frame can be implemented as a continuous rod or as multiple rod segments configured to be assembled into a closed perimeter structure. By virtue of its rigidity, the rigid outer frame maintains a consistent perimeter geometry on a variety of playing surfaces, thereby providing a stable reference boundary that is suitable not only for recreational play, but also for more demanding tournament, league, and professional play environments in which court geometry and boundary determinacy are expected to be repeatable.

An inner hub is disposed within the outer boundary. In exemplary embodiments, the inner hub comprises a flexible sheet material that can be placed on the playing surface and can support multiple connection points without requiring a rigid central post or other obstructive structure. The inner hub includes a plurality of hub-side attachment locations distributed about a perimeter region of the inner hub. Each hub-side attachment location can include, for example, an inner fastener configured to removably couple to a corresponding cord fastener of a divider cord. In this arrangement, one or more divider cords can be anchored at their first ends to selected hub-side attachment locations, allowing players, referees, or event organizers to deploy a standardized court configuration or to adapt the court configuration based on an expected number of players or a defined play format.

A plurality of divider cords extend between the inner hub and the rigid outer frame. Each divider cord includes a first end configured to be removably coupled to any selected one of the hub-side attachment locations and a second end configured to be removably coupled to the rigid outer frame at a selectable attachment location along the rigid outer frame. In exemplary embodiments, the second end includes a cord clip configured to snap around an exterior surface of the rigid outer frame such that the divider cord can be attached at substantially any location along the rigid outer frame, rather than only at predetermined anchor points. The divider cords can further include an elastic cord portion configured to be stretched during installation so that, when coupled between the inner hub and the rigid outer frame, the divider cords are maintained taut. The taut divider cords cooperatively define multiple playing sections arranged circumferentially about the inner hub, and the taut condition provides visually determinable boundary segments that improve consistency and reduce disputes regarding boundary-related gameplay conditions. This boundary determinacy can be particularly beneficial in organized play, where consistent calls and repeatable enforcement of court boundaries can be required by a rule set and can be expected by players and officiating personnel.

A further advantage is that the system is configured for in-place reconfiguration while the rigid outer frame remains assembled and deployed. During gameplay, one or more divider cords may be detached and reattached to different hub-side attachment locations and/or different locations along the rigid outer frame, thereby changing a number of playing sections and/or changing a size of one or more playing sections without requiring removal of the system from the playing surface. This functionality enables players or event organizers to adapt court configuration in response to changing gameplay conditions, including formats in which participant count changes between rounds or as players are eliminated, while preserving the stability and boundary determinacy provided by the rigid outer frame.

In exemplary embodiments, friction marker attachments may be applied to the rigid outer frame to abate sliding of cord clips under tension and to provide visual indicators, optionally including color-coded indicators, that assist players or officials in selecting attachment locations corresponding to standardized two-section, three-section, four-section, or other playing-section configurations. In additional exemplary embodiments, a divider cord can include a strap retainer configured to manage a loose end portion of the divider cord after passing through a hub-side cord fastener, enabling adjustment of an effective divider cord length to accommodate different court diameters or desired section geometries while maintaining tension. In still further embodiments, a cord clip can be secured to an end of a divider cord via a permanent divider cord attachment, such as a rivet or other securing structure, to enhance durability and repeatability across repeated deployments and repeated competitive sessions.

Accordingly, the disclosed court architecture combines a rigid outer frame, a flexible inner hub, and elastically tensioned divider cords that are repositionable at both the inner hub and the rigid outer frame. This structural cooperation supports a stable outer boundary, facilitates visually determinable internal boundaries, and enables rapid reconfiguration of playing sections as part of normal gameplay. As a result, the system can support both recreational use and more rigorous tournament, league, and professional play contexts in which court stability, boundary determinacy, and repeatable configuration are desired.

Definitions

In the present invention, the term "reconfigurable" is intended to mean capable of being adjusted, resized, rearranged, or otherwise changed in configuration, including during gameplay and while the rigid outer frame remains assembled and deployed, such as by relocating one or more divider cords to different attachment locations.

In the present invention, the term "rigid outer frame" is intended to mean a perimeter boundary structure that, when assembled, defines an outer boundary of the playing court and is sufficiently stiff to maintain a repeatable perimeter geometry under expected gameplay forces and divider-cord tension forces, including implementations formed from a continuous rod or a segmented rod.

In the present invention, the term "assembled" (with respect to the rigid outer frame) is intended to mean arranged into a closed-loop court-defining geometry for play, whether formed from a single continuous member or multiple interconnected segments.

In the present invention, the term "inner hub" is intended to mean a component disposed within the outer boundary that provides one or more discrete coupling locations for divider cords, thereby acting as a central coupling platform for defining, repeating, and reconfiguring playing-section boundaries.

In the present invention, the term "perimeter region" (with respect to the inner hub) is intended to mean a peripheral area of the inner hub at or near an outer edge of the inner hub where discrete hub-side attachment locations can be positioned to receive divider-cord connections.

In the present invention, the term "inner fastener" is intended to mean a hub-side connector component coupled to the inner hub and configured to removably interconnect with a corresponding cord fastener on a divider cord, including buckle, snap, hook-and-loop, button, loop-and-toggle, or other removable coupling structures.

In the present invention, the term "cord fastener" is intended to mean a cord-side connector component coupled to a divider cord and configured to removably interconnect with an inner fastener on the inner hub to couple the divider cord to a selected hub attachment location.

In the present invention, the term "interconnectable fastener pair" is intended to mean a mating pair of fastener components, one on the inner hub and one on the divider cord, that removably engage one another to couple the divider cord to the inner hub.

In the present invention, the term "hub attachment location" is intended to mean a discrete location on the inner hub at which an inner fastener is disposed, such that selecting different hub attachment locations changes a geometry and/or angular placement of a divider cord relative to the inner hub.

In the present invention, the term "distributed substantially uniformly" (with respect to inner fasteners) is intended to mean arranged around the perimeter region of the inner hub in a generally even spacing pattern to support repeatable angular positions for divider placement when recreating a desired section geometry.

In the present invention, the term "divider cord" is intended to mean an elongated flexible member extending between the inner hub and the rigid outer frame to define at least part of a boundary of one or more playing sections, and which can include elastic portions and/or length-management features to enable tensioning and repeatable boundary definition.

In the present invention, the term "elastically tensioned" is intended to mean placed under tension by stretching an elastic portion of a divider cord between the inner hub and the rigid outer frame such that the divider cord resists slack and provides a stable, visually determinable boundary during play.

In the present invention, the term "taut" is intended to mean maintained in a tensioned condition such that a divider cord remains generally straight along its length and lies generally flat relative to the playing surface to provide a readily perceivable boundary for in-bounds and out-of-bounds determinations.

In the present invention, the term "selectable attachment location" (along the rigid outer frame) is intended to mean a location that can be chosen by a user for coupling a divider cord to the rigid outer frame, including a continuously selectable position along the rigid outer frame and/or a set of discrete positions indicated or facilitated by marker features.

In the present invention, the term "cord clip" (or "snap clip") is intended to mean an outer-end connector of a divider cord configured to removably engage the rigid outer frame, including a resilient, generally C-shaped clip body sized for snap-fit engagement around a tubular portion of the rigid outer frame.

In the present invention, the term "friction marker attachment" is intended to mean a feature disposed on the rigid outer frame that increases friction between the rigid outer frame and a cord clip to abate sliding under divider-cord tension and that can also provide a visual indicator of preferred divider-cord attachment locations for repeatable court setup.

In the present invention, the term "playing section" is intended to mean a region of the playing court assigned to a player and bounded by (i) an outer boundary defined by the rigid outer frame, (ii) an inner boundary proximate the inner hub region, and (iii) adjacent divider boundaries defined by divider cords.

In the present invention, the term "boundary segment" is intended to mean a portion of a divider cord that defines a boundary between adjacent playing sections when the divider cord is coupled and tensioned between the inner hub and the rigid outer frame.

In the present invention, the term "boundary plane" is intended to mean a plane extending upward from a divider boundary (e.g., from a taut divider cord) that is used to evaluate whether a player and/or a paddle crosses into an adjacent playing section during a hit.

In the present invention, the term "in-bounds" is intended to mean within a defined playing section, and the term "out-of-bounds" is intended to mean outside the outer boundary and/or inside the inner boundary, depending on the selected gameplay configuration and rules.

In the present invention, the term "active player" is intended to mean a player currently participating in gameplay within an assigned playing section, and the term "eliminated player" (or "taken out") is intended to mean a player removed from active gameplay in response to a gameplay condition such as reaching a predefined point threshold.

In the present invention, the term "predefined gameplay rules" is intended to mean a selected set of rules governing at least scoring, fault/replay conditions, and player elimination and/or continuation criteria, where the rules can be provided in a printed or digital instruction medium and can vary between play formats.

In the present invention, the term "predefined gameplay condition" is intended to mean an event or state recognized under the gameplay rules that triggers a change in gameplay and/or court configuration, including a change in the number of active players and/or an elimination event.

In the present invention, the term "replay condition" is intended to mean a rule-defined condition in which a rally or point is replayed rather than scored, including when a ball contacts a divider boundary or when a player violates a boundary-plane restriction.

In the present invention, the term "reconfigure during gameplay" is intended to mean detaching and reattaching at least one divider cord to change at least a number of playing sections and/or a size of at least one playing section while the rigid outer frame remains assembled and deployed, and gameplay is ongoing or resumes without dismantling the rigid outer frame.

In the present invention, the term "unequal playing sections" is intended to mean playing sections intentionally configured with different areas and/or different boundary placements to accommodate different skill levels, to balance competitiveness, and/or to implement a selected competitive format.

In the present invention, the term "kit" is intended to mean a packaged collection of components sufficient to deploy and play using the court system, including at least the rigid outer frame, inner hub, divider cords, and a carrying bag, and optionally including paddles, a game ball, spare parts, and configuration guidance media.

In the present invention, the term "carrying bag" is intended to mean a container configured to store and transport at least the rigid outer frame, the inner hub, and the divider cords, and optionally the paddles and game ball, including embodiments with internal compartments and retention features that reduce tangling and protect kit components.

In the present invention, the term "about" is intended to mean approximately, allowing for typical manufacturing tolerances and measurement variability for the relevant context, including for court diameter ranges and angular spacing.

In the present invention, the term "approximately" is intended to mean near or close to a stated value, inclusive of reasonable variation based on application constraints, measurement method, and component tolerances.

In the present invention, the term "substantially" is intended to mean largely but not necessarily wholly, such that minor deviations consistent with normal use, tolerances, and environmental conditions do not materially change the described function, including for "substantially uniformly" distributed inner fasteners and "substantially taut" divider boundaries.

In the present invention, the term "degrees of arc" is intended to mean an angular spacing measured about a center point of a component or court geometry, such that locations "spaced at X degrees of arc" are separated by an included angle of approximately X degrees when viewed about the center point, including angular spacing around a perimeter region of the inner hub and or around the rigid outer frame.

Turning now to the drawings in greater detail, it will be seen that in FIG. 1, there is illustrated one example of a reconfigurable paddle ball court system 100 and associated gameplay configurations that can be selectively established and adjusted during play.

Referring to FIG. 1, there is illustrated, in reference 'A', one example of the paddle ball court system 100 defining an interior play region 108 within a rigid outer frame 102, and further illustrating example players 202 using paddles 118 to strike a game ball 122 during gameplay. In the illustrated example, an inner hub 110 can be disposed within the interior play region 108 and can serve as a central coupling platform from which a plurality of divider cords 114 extend outward to the rigid outer frame 102. Each divider cord 114 can be coupled to the inner hub 110 via an interconnectable fastener pair 142/144 that includes a hub-side inner fastener 142 coupled to the inner hub 110 and a cord-side cord fastener 144 coupled to the divider cord 114. In an exemplary embodiment, the inner fastener 142 can comprise a buckle receiver, and the cord fastener 144 can comprise a mating buckle component, although other suitable fastener types can be used. Each divider cord 114 can further be coupled to the rigid outer frame 102 via a cord clip 146. In this arrangement, the divider cords 114 can cooperate with the rigid outer frame 102 and inner hub 110 to define a plurality of playing sections 116A within the interior play region 108, such that each playing section 116A can be bounded at least in part by one or more divider cords 114 and the rigid outer frame 102.

In an exemplary embodiment, the rigid outer frame 102 can be configured as a rigid or semi-rigid boundary structure that maintains a repeatable perimeter geometry when assembled and deployed, thereby providing a visually determinable rigid outer boundary for the interior play region 108. This repeatability can be advantageous relative to prior approaches that rely on compliant boundary elements that may deform during use, because a stable outer boundary can improve consistency in determining whether the game ball 122 is in-bounds or out-of-bounds relative to the rigid outer frame 102. In an exemplary embodiment, each divider cord 114 can include an elastic portion such that, when the divider cord 114 is coupled between the inner hub 110 at a selected inner fastener 142 by interconnection with the cord fastener 144, and coupled to the rigid outer frame 102 via the cord clip 146, the divider cord 114 can be placed under tension and maintained taut across the interior play region 108. Maintaining the divider cords 114 taut can provide visually determinable boundary segments between adjacent playing sections 116A, which can reduce boundary ambiguity during gameplay and can support more consistent enforcement of gameplay conditions for recreational play as well as more rigorous tournament, league, and professional play environments.

In an exemplary embodiment, the inner fasteners 142 can be implemented as discrete coupling features positioned about a perimeter region of the inner hub 110 and configured to removably interconnect with corresponding cord fasteners 144 disposed on the divider cords 114. For example, a given divider cord 114 can include a cord fastener 144 configured to be removably engaged with one of the inner fasteners 142, such as by snap engagement, buckle engagement, hook-and-loop engagement, button engagement, loop-and-toggle engagement, or other suitable removable coupling. In an exemplary embodiment, the inner fasteners 142 can be distributed substantially uniformly about the inner hub 110 so that divider cords 114 can be coupled at repeatable angular positions relative to the inner hub 110, thereby enabling consistent section geometry when a desired configuration is recreated. In an exemplary embodiment, the inner fasteners 142 can include multiple types or styles of receiver structures to accommodate different fastener types, to provide different tension characteristics, or to provide different cord-routing paths at the inner hub 110, thereby allowing a divider cord 114 to be coupled in more than one manner depending on a selected gameplay configuration.

In an exemplary embodiment, the cord clip 146 at the outer end of the divider cord 114 can be configured to removably snap around an exterior surface of the rigid outer frame 102, thereby enabling the divider cord 114 to be attached at a selectable attachment location along the rigid outer frame 102. This selectable attachment capability can provide a practical advantage in that a player can adjust section size and geometry without being constrained to fixed perimeter anchor points. In an exemplary embodiment, the cord clip 146 can include a resilient clip body having a generally C-shaped profile that elastically deforms during installation over the rigid outer frame 102 and returns toward an undeformed state to retain the rigid outer frame 102 by snap-fit engagement. In an exemplary embodiment, the cord clip 146 can include a friction surface, a textured insert, an interference feature, or other engagement geometry configured to resist sliding along the rigid outer frame 102 under tension applied by the divider cord 114.

In an exemplary embodiment, one or more friction marker attachments 152 can be disposed on the rigid outer frame 102 at one or more locations. Each friction marker attachment 152 can be configured to increase friction between the cord clip 146 and the rigid outer frame 102 so as to abate sliding of the cord clip 146 along the rigid outer frame 102 during gameplay. For example, a friction marker attachment 152 can include a tape segment, textured coating, elastomeric sleeve, overmolded patch, knurled region, or other friction-enhancing feature applied to the rigid outer frame 102. In an exemplary embodiment, the friction marker attachment 152 can also provide a visual indicator of preferred cord clip attachment locations, which can assist players in quickly achieving a desired court configuration. In an exemplary embodiment, the friction marker attachments 152 can be positioned in a pattern corresponding to common playing-section configurations, and can optionally be color-coded such that players can identify which friction marker attachments 152 correspond to a two-section configuration, a three-section configuration, a four-section configuration, or another configuration. In this manner, the friction marker attachments 152 can serve both a mechanical function of resisting clip sliding and an operational function of guiding repeatable court setup in a way that can be useful for league or tournament play in which standardized configurations may be desirable.

Referring still to FIG. 1, reference 'B' illustrates another example configuration of the paddle ball court system 100 in which the divider architecture can be adjusted to change the number of playing sections and or the relative size of one or more playing sections, while the rigid outer frame 102 remains assembled and deployed. In the illustrated example of reference 'B', divider cords 114A and 114B can be coupled to the inner hub 110 by interconnection of respective fastener pairs 142/144 and can be coupled to the rigid outer frame 102 via corresponding cord clips 146 to define a different arrangement of playing sections, including a playing section 116B and one or more playing sections 116C. In an exemplary embodiment, the divider cords 114A and 114B can represent different divider cord configurations, such as different effective lengths, different elastic characteristics, different connector arrangements, or combinations thereof, thereby enabling different section geometries while maintaining taut boundaries. In an exemplary embodiment, because the cord clips 146 can be removably coupled to the rigid outer frame 102, the attachment location of a given divider cord 114A or 114B along the rigid outer frame 102 can be selected and changed without disassembling the rigid outer frame 102, and because the hub-side coupling can be made by selecting a given inner fastener 142 for interconnection with the cord fastener 144, the same divider cord can be relocated to a different hub attachment location on the inner hub 110.

In an exemplary embodiment, the ability to selectively choose hub-side attachment locations at the inner hub 110 (via selection among the inner fasteners 142) and perimeter attachment locations along the rigid outer frame 102 can enable not only changes in the number of playing sections, but also intentional tailoring of the relative size of playing sections to accommodate different play contexts. For example, the configuration shown in reference 'B' can include a playing section 116B that is larger than one or more other playing sections 116C. Such a configuration can be used to accommodate players 202 of different skill levels by providing a larger defensive area or return area to a less experienced player, or by constraining a more experienced player to a smaller area to balance competitive gameplay. In another example, section sizes can be configured to reflect different roles or rule-based assignments, such as a "challenge" section having a smaller area, a "bonus" section having a larger area, or other competitive balancing arrangements in which court geometry is used as an adjustable variable. In an exemplary embodiment, this balancing can be adjusted dynamically during gameplay by moving one or more cord clips 146 to different friction marker attachments 152 and or by changing which inner fasteners 142 are used at the inner hub 110, thereby changing one or more boundary segments while the rigid outer frame 102 remains deployed.

In an exemplary embodiment, the illustrated arrangement in which the divider cords 114, 114A, and 114B extend between the inner hub 110 and the rigid outer frame 102, rather than spanning across or intersecting a central post, can provide an unobstructed central region while still providing a hub-based reference for repeatable divider placement. In an exemplary embodiment, the inner hub 110 can be configured to remain generally planar relative to a playing surface and to distribute loads from the divider cords 114 through the hub material, while the rigid outer frame 102 can react tension forces applied by the divider cords 114 through its rigid perimeter structure. This cooperative structural relationship between the rigid outer frame 102, the inner hub 110, the divider cords 114, the inner fasteners 142, the cord fasteners 144, the cord clips 146, and the friction marker attachments 152 can support repeatable court geometry, taut internal boundaries, and in-place reconfiguration, providing a technical improvement over prior approaches that may be more susceptible to boundary distortion or that may not be configured for rapid, rule-driven court resizing during ongoing play.

Figure 2:
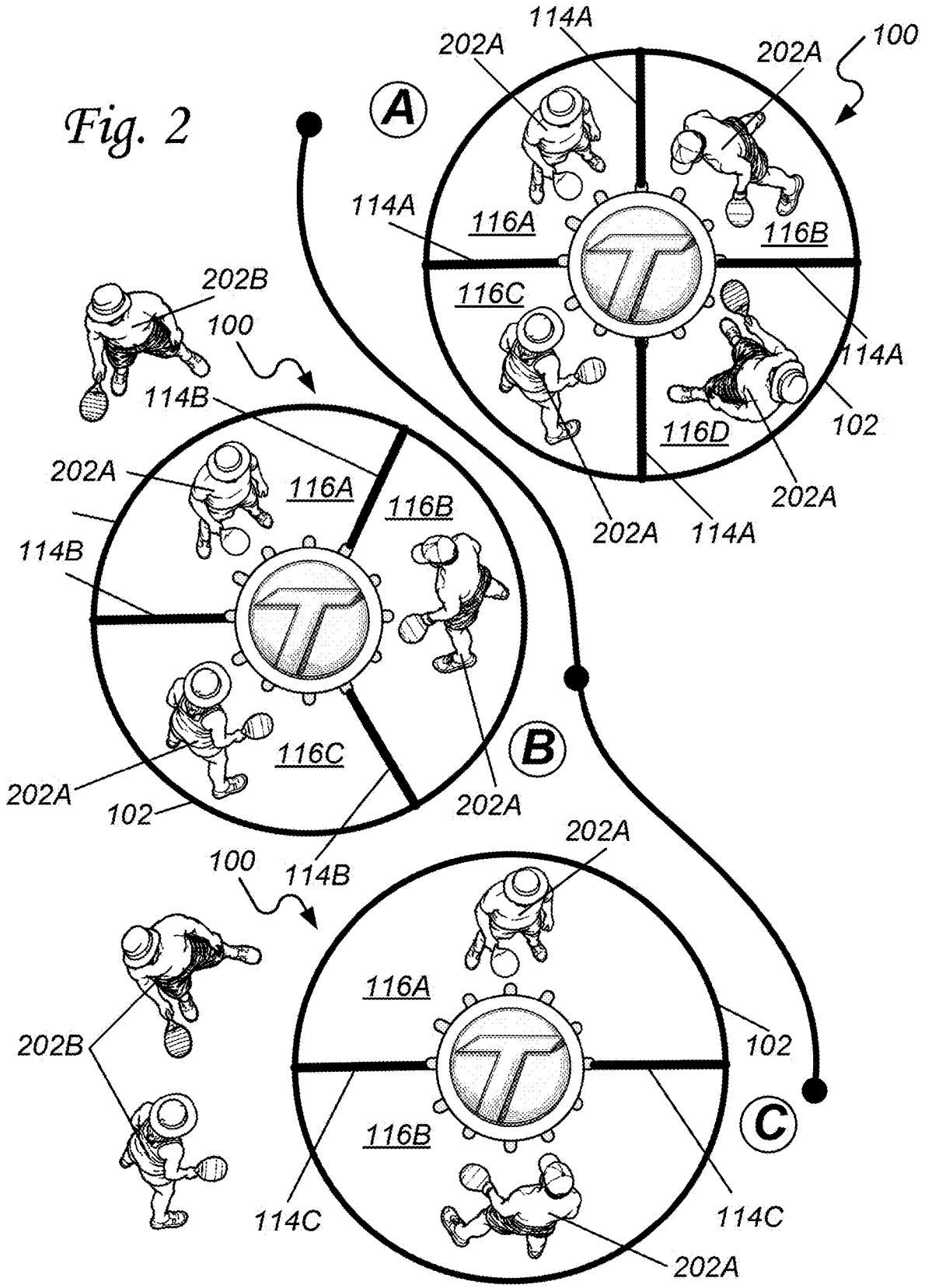

FIG. 2 illustrates one example of a progression of gameplay and in-game court reconfiguration using the reconfigurable paddle ball court system 100 as active players are taken out of play.

Exemplary Gameplay Rules and Court Reconfiguration

In an exemplary embodiment, the paddle-and-ball game played using the reconfigurable paddle ball court system 100 can be governed by predefined gameplay rules in which a primary objective is to remain the last active player in the game by avoiding accumulation of points, where points can be accrued when a game ball drops within a player's assigned playing section and or when the player causes the game ball to go out of bounds. In this exemplary embodiment, a "Takeout" or elimination event can occur when a player reaches a predefined point threshold, such as eleven points, at which time that player can be removed from active gameplay. The last remaining active player can be declared the winner.

In an exemplary embodiment, gameplay can be conducted with two, three, or four players, and the playing court can be divided into playing sections that are equal in size or intentionally unequal in size to accommodate different skill levels, to balance competitiveness among players, and or to implement a selected competitive format. For example, a higher-skilled player can be assigned a larger playing section, while a lower-skilled player can be assigned a smaller playing section, thereby modulating difficulty and improving competitive balance. In an exemplary embodiment, each playing section can be defined as a region between an outer boundary and an inner boundary and between adjacent divider boundaries. Out-of-bounds can be defined as outside the outer boundary and or inside the inner boundary, and in certain configurations, a dead zone can be provided between adjacent playing sections for particular play modes.

In an exemplary embodiment, the predefined gameplay rules can include replay conditions that preserve fairness and reduce disputes arising from boundary interactions. For example, if the game ball lands on a divider boundary of an active playing section, the rally can be replayed rather than scored. In another example, if the game ball contacts an outer boundary structure, the ball can remain live and playable, while contact with an inner boundary can be treated as out-of-bounds, such that the player who last struck the ball accrues a point.

In an exemplary embodiment, play can begin with a serve performed underhanded and directed to any opponent, where a serve hit out of bounds can be replayed and where double faults can be omitted to keep play continuous. In an exemplary embodiment, scoring can be deferred until after a sequence of hits has occurred, such as by disallowing point accrual on the serve and on the second hit following the serve, while allowing points to be accrued on a third hit and subsequent hits. In an exemplary embodiment, the rules can emphasize controlled deflection rather than power hitting, including requiring underhanded strikes in which the ball travels upward or sideways from the paddle after contact and treating downward spikes as a replay condition. In an exemplary embodiment, the rules can further include a boundary-plane restriction in which a player is to keep the paddle within the player's own playing section and not cross a vertical plane defined by a divider boundary when striking the ball, and if such a fault occurs the point can be replayed.

In an exemplary embodiment, a defining concept of the game can be that elimination of one or more players during gameplay triggers a corresponding reconfiguration of the playing sections so that the remaining active players continue play using a court layout appropriate for the reduced player count. For example, when a four-player game becomes a three-player game after an elimination event, the court can be reconfigured so the outer court is divided into three playing sections, and when play reaches two active players, the court can be reconfigured to position the two remaining players across from one another while adjusting section size based on skill level and or environmental conditions. In an exemplary embodiment, court rotation rules can also be applied, such as rotating player positions after each point or after a selected number of points, to improve fairness under wind, sun, or other environmental conditions.

In an exemplary embodiment, gameplay using the paddle ball court system 100 can implement a points system in which points are treated as a penalty condition, such that a player seeks to avoid accumulating points while attempting to cause one or more opponents to accumulate points. In this exemplary embodiment, points can be accrued in at least two primary ways. A first way can occur when the game ball lands within a player's assigned playing section, such that the player assigned to that playing section receives a point. A second way can occur when the player strikes the game ball out of bounds, in which case that player receives a point. In this manner, the points system can incentivize controlled placement of the game ball into an opponent's playing section while discouraging uncontrolled shots that cause out-of-bounds conditions.

In an exemplary embodiment, point accrual can be suppressed during an initial sequence of hits following a serve in order to promote longer rallies and avoid immediate penalty conditions. For example, a player may be prevented from earning a point or losing a point on a serve, and a point may likewise be prevented from being earned on a second hit following the serve, while allowing points to be scored starting on a third hit and subsequent hits. This structure can reduce disputes over early-contact events, maintain continuity of play, and can encourage a consistent "put the ball in play" serve that initiates a rally rather than immediately determining a scoring outcome.

In an exemplary embodiment, a "Takeout" elimination condition can be triggered when a player reaches a predefined point threshold, such as eleven points or other predetermined number, at which time the player can be taken out of the game and required to exit active play. In this exemplary embodiment, the game can continue until a last remaining active player remains, who can be declared the winner. In an exemplary embodiment, players can self-track points and can announce scores prior to a serve to maintain shared awareness of each player's current score and the proximity to a Takeout trigger.

In an exemplary embodiment, while particular point thresholds, replay rules, serve sequences, and rotation intervals can vary, the game can still be characterized by (i) elimination of players upon reaching a predefined threshold and (ii) in-game reconfiguration of the court into a different number of playing sections, and optionally different relative section sizes, so that gameplay continues with a layout matched to the active number of players.

Exemplary System and Method Embodiments

In an exemplary embodiment, the paddle ball court system 100 can comprise a rigid outer frame 102 configured, when assembled, to define an outer boundary of a playing court, and an inner hub 110 disposed within the outer boundary. In an exemplary embodiment, a plurality of inner fasteners 142 can be coupled to the inner hub 110 and distributed about a perimeter region of the inner hub 110, and a plurality of divider cords 114 can be provided for defining internal boundaries within an interior play region 108 of the playing court.

In an exemplary embodiment, each divider cord 114 can have (i) a first end that is removably coupleable to any selected one of the plurality of inner fasteners 142 on the inner hub 110, and (ii) a second end that is removably coupleable to the rigid outer frame 102 at a selectable attachment location along the rigid outer frame 102. In an exemplary embodiment, the first end of a given divider cord 114 can include a cord fastener 144 configured to removably interconnect with a selected inner fastener 142 to form an interconnectable fastener pair 142/144, and the second end can include a cord clip 146 configured to removably couple to the rigid outer frame 102.

In an exemplary embodiment, when coupled between the inner hub 110 and the rigid outer frame 102, the plurality of divider cords 114 can be maintained taut and can cooperatively define a plurality of playing sections 116 arranged circumferentially about the inner hub 110. In an exemplary embodiment, the divider cords 114 can be elastically tensioned when installed, such as by including an elastic cord portion configured to be stretched to provide tension when coupled between the inner hub 110 and the rigid outer frame 102, thereby providing visually determinable boundary segments that remain straight and stable during gameplay.

In an exemplary embodiment, the plurality of divider cords 114 can be detached and reattached during gameplay to change at least one of (a) a number of the plurality of playing sections 116 and (b) a size of at least one playing section 116, while the rigid outer frame 102 remains assembled and deployed. In an exemplary embodiment, such reconfiguration can be performed by detaching at least one divider cord 114 from a first inner fastener 142 and reattaching the divider cord 114 to a different inner fastener 142, and by detaching the cord clip 146 from a first attachment location along the rigid outer frame 102 and reattaching the cord clip 146 to a different selectable attachment location along the rigid outer frame 102.

In an exemplary embodiment, the rigid outer frame 102 can comprise at least one of a metal frame, a continuous rod, or a segmented rod, and can be configured to maintain a repeatable perimeter geometry when assembled. In an exemplary embodiment, the plurality of inner fasteners 142 can comprise at least eight inner fasteners distributed substantially uniformly about the perimeter region of the inner hub 110, and in a further exemplary embodiment, the plurality of inner fasteners 142 can comprise twelve inner fasteners distributed at approximately thirty-degree of arc increments about the perimeter region.

In an exemplary embodiment, the rigid outer frame 102 can further include a plurality of friction marker attachments 152 distributed substantially uniformly around the rigid outer frame 102 to provide repeatable, indexed perimeter attachment locations for cord clips 146 and to abate clip sliding under divider-cord tension. In a further exemplary embodiment, the rigid outer frame 102 can include thirty-six friction marker attachments 152 equally positioned around the rigid outer frame 102, such that adjacent friction marker attachments 152 are separated by approximately ten degrees of arc, thereby providing a higher-resolution set of selectable perimeter attachment locations that can be used to consistently recreate common court configurations and or to fine-tune playing section geometry while maintaining taut divider cords 114.

In an exemplary embodiment, a method of using the paddle ball court system 100 can comprise coupling the plurality of divider cords 114 between the inner hub 110 and the rigid outer frame 102 to define a first number of playing sections 116, conducting gameplay using the first number of playing sections 116, and during the gameplay changing the first number of playing sections 116 to a second number of playing sections 116 by detaching at least one divider cord 114 and reattaching the at least one divider cord 114 to a different inner fastener 142 and to a different attachment location along the rigid outer frame 102, wherein the second number of playing sections 116 is a different number than the first number of playing sections 116, and continuing gameplay with the second number of playing sections 116.

In an exemplary embodiment, the paddle ball court system 100 can further comprise a kit that includes at least one carrying bag 124 and at least one of (i) a plurality of paddles 118 and (ii) at least one game ball 122, wherein the carrying bag 124 can be configured to receive the rigid outer frame 102, the plurality of divider cords 114 for transport, the plurality of paddles 118, and the at least one game ball 122.

Referring to FIG. 2, there is illustrated, in reference 'A', the paddle ball court system 100 deployed for a first gameplay configuration in which a plurality of active players 202A are positioned around a rigid outer frame 102 and the playing court is divided into a first arrangement of playing sections 116A, 116B, 116C, and 116D by a plurality of divider cords 114A. In this configuration, each divider cord 114A can extend between an inner hub 110 region of the playing court and the rigid outer frame 102 so as to define boundary segments that partition the interior into the multiple playing sections 116A-116D. In an exemplary embodiment, the divider cords 114A can be elastically tensioned when installed such that each divider cord 114A is maintained in a taut condition and presents a visually distinct boundary that remains generally straight along its length, lies flat relative to the playing surface, and has a boundary width that is readily perceivable by players. This taut, straight, and flat boundary presentation can reduce sagging, curling, or lateral shifting of the divider cords 114A during rallies, thereby making in-bounds and out-of-bounds calls more consistent and easier to judge relative to each playing section 116A-116D and the rigid outer frame 102, including during fast-paced exchanges and in competitive play formats where repeatability of boundary determinations can be important.

In an exemplary embodiment, during play of the configuration shown in reference 'A', one or more predefined scoring conditions can cause an elimination event in which one player 202B is taken out of the game. Following such a takeout event, reference 'B' illustrates the paddle ball court system 100 reconfigured for a second gameplay configuration in which three active players 202A remain positioned around the rigid outer frame 102, and one eliminated player 202B is outside the playing court and no longer participates as an active player. In this second configuration, the playing court can be redivided into a reduced number of playing sections, such as three sections, by relocating at least one of the divider cords 114B relative to the court. More particularly, one or more divider cords 114B can be detached and reattached such that the boundary segments are redistributed to form a new arrangement of playing sections appropriate for the reduced number of active players 202A, while the rigid outer frame 102 can remain assembled and deployed. In an exemplary embodiment, this in-place reconfiguration can be performed quickly so gameplay can continue without fully dismantling and rebuilding the playing court, and without sacrificing the repeatable perimeter geometry of the rigid outer frame 102.

Referring still to FIG. 2, reference 'C' illustrates a further progression in which an additional takeout event has occurred such that two active players 202A remain and two eliminated players 202B who are inactive and no longer playing the game are outside the playing court. In this configuration, the paddle ball court system 100 can again be reconfigured by relocating one or more divider cords 114C so the playing court is divided into a two-player arrangement that can position the remaining active players 202A relative to one another in a desired orientation, such as directly across from one another. In an exemplary embodiment, the divider cords 114C can be repositioned such that each active player 202A is assigned a corresponding playing section, and the section boundaries can be maintained taut to provide clear, visually determinable boundaries during continued gameplay.

In an exemplary embodiment, the progression illustrated in references 'A', 'B', and 'C' can further include intentionally adjusting the relative size of the playing sections as the active player count changes, including creating equal-sized sections or unequal-sized sections. For example, in reference 'B', one playing section can be configured larger than another to balance competitive play among remaining active players 202A, such as to accommodate differences in skill level, endurance, reach, reaction time, or other player attributes. In reference 'C', the two-player configuration can likewise be adjusted such that each player's playing section can occupy approximately half of the playing court, or a smaller portion of the playing court, depending on selected rules or desired competitiveness. In an exemplary embodiment, this ability to change not only the number of playing sections, but also the relative size and geometry of those playing sections, can be achieved by moving the divider cords 114A-114C to different attachment locations along the rigid outer frame 102 and or by changing the inner-end placement of the divider cords 114A-114C, thereby enabling the court layout to be tuned dynamically as a function of gameplay progression.

In an exemplary embodiment, the progression shown in FIG. 2 reflects technical cooperation between (i) the rigid outer frame 102, which can define a stable perimeter geometry for the playing court, (ii) the inner hub 110, which can provide a centralized, flexible coupling region having a plurality of hub-side attachment locations for the divider cords, and (iii) the divider cords 114A-114C, which can be elastically tensioned between the inner hub 110 and the rigid outer frame 102 to form visually determinable internal boundary segments that divide the court into the playing sections 116A-116D. In this arrangement, tension in the divider cords 114A-114C can be distributed into the inner hub 110 and reacted by the rigid outer frame 102 such that the divider cords 114A-114C remain generally taut and maintain intended boundary alignment during gameplay. In an exemplary embodiment, the system 100 can remain deployed while being reconfigured from the reference 'A' configuration to the reference 'B' configuration and to the reference 'C' configuration by relocating one or more of the divider cords 114A-114C relative to the inner hub 110 and or the rigid outer frame 102, such that the number and or relative size of the playing sections 116A-116D changes as active players 202A are taken out of play and become eliminated players 202B.

Additional Exemplary System and Method Embodiments

In an exemplary embodiment, the paddle ball court system 100 can comprise a rigid outer frame 102 that defines an outer perimeter boundary of a playing court when assembled, and an inner hub 110 positioned within the rigid outer frame 102. In an exemplary embodiment, a plurality of divider cords 114 can be provided, each divider cord 114 extending between the inner hub 110 and the rigid outer frame 102 to define internal boundary segments that partition the playing court into a plurality of playing sections 116.

In an exemplary embodiment, each divider cord 114 can comprise an inner-end connector configured to removably couple to the inner hub 110 at one of a plurality of discrete hub attachment locations. In an exemplary embodiment, the discrete hub attachment locations can be implemented as a plurality of inner fasteners 142 disposed about a perimeter region of the inner hub 110, and the inner-end connector can be implemented as a cord fastener 144 configured to removably interconnect with a selected inner fastener 142 to form an interconnectable fastener pair 142/144. In an exemplary embodiment, the plurality of inner fasteners 142 can include at least twelve inner fasteners 142 spaced at approximately thirty-degree of arc increments around the perimeter region of the inner hub 110, thereby providing a discrete angular indexing scheme for divider placement and repeatable section geometry.

In an exemplary embodiment, each divider cord 114 can further comprise an outer-end connector comprising a snap clip configured to removably engage the rigid outer frame 102 at any of a plurality of selectable positions along the rigid outer frame 102. In an exemplary embodiment, the snap clip can comprise a resilient, generally C-shaped clip body sized to receive a tubular portion of the rigid outer frame 102 in snap-fit engagement. In an exemplary embodiment, the snap clip can be installed and removed without tools, such that a user can relocate the outer-end connector along the rigid outer frame 102 to change boundary geometry and or playing section size during a match.

In an exemplary embodiment, each of the plurality of divider cords 114 can be elastically tensioned between the inner hub 110 and the rigid outer frame 102. In an exemplary embodiment, the elastic tension can reduce distortion of boundary geometry during gameplay by maintaining the divider cords 114 taut and by resisting slackening or lateral migration that would otherwise alter internal boundary locations. In an exemplary embodiment, by maintaining taut divider cords 114 and a repeatable rigid outer frame 102 perimeter, the system can facilitate determination of in-bounds and out-of-bounds conditions relative to the playing sections 116 and the rigid outer frame 102.

In an exemplary embodiment, the rigid outer frame 102 can comprise a plurality of friction marker attachments 152 positioned along the rigid outer frame 102. In an exemplary embodiment, the friction marker attachments 152 can resist the snap clip sliding along the rigid outer frame 102 under tension applied by the divider cords 114, such as by increasing friction between the snap clip and the rigid outer frame 102. In an exemplary embodiment, the friction marker attachments 152 can additionally provide visual placement indicators that guide users to repeatable snap-clip attachment locations for common court configurations.

In an exemplary embodiment, each of the plurality of divider cords 114 can be configured such that, when tensioned, each divider cord 114 defines a boundary segment that does not cross the center of the playing court. In an exemplary embodiment, each divider cord 114 can extend from the perimeter region of the inner hub 110 outward to the rigid outer frame 102, thereby forming a radial or chord-like boundary segment that partitions adjacent playing sections 116 while leaving a central region unobstructed and while maintaining a consistent reference geometry defined by the inner hub 110.

In an exemplary embodiment, a method of using the paddle ball court system 100 can comprise configuring the system with a first set of the plurality of divider cords 114 to define a first arrangement of playing sections 116 for a first number of players. In an exemplary embodiment, thereafter, in response to a change in the number of players during gameplay, the system can be reconfigured by moving at least one divider cord 114 to a different hub attachment location on the inner hub 110 (e.g., moving the cord fastener 144 to a different inner fastener 142) and moving the snap clip to a different position along the rigid outer frame 102 to define a second arrangement of playing sections 116 for a second number of players. In an exemplary embodiment, gameplay can then be continued with the second arrangement while the rigid outer frame 102 remains assembled and deployed.

In an exemplary embodiment, the paddle ball court system 100 can further comprise a kit including a carrying bag 124 configured to store the rigid outer frame 102, the inner hub 110, and the divider cords 114 for transport and storage.

Figure 3:
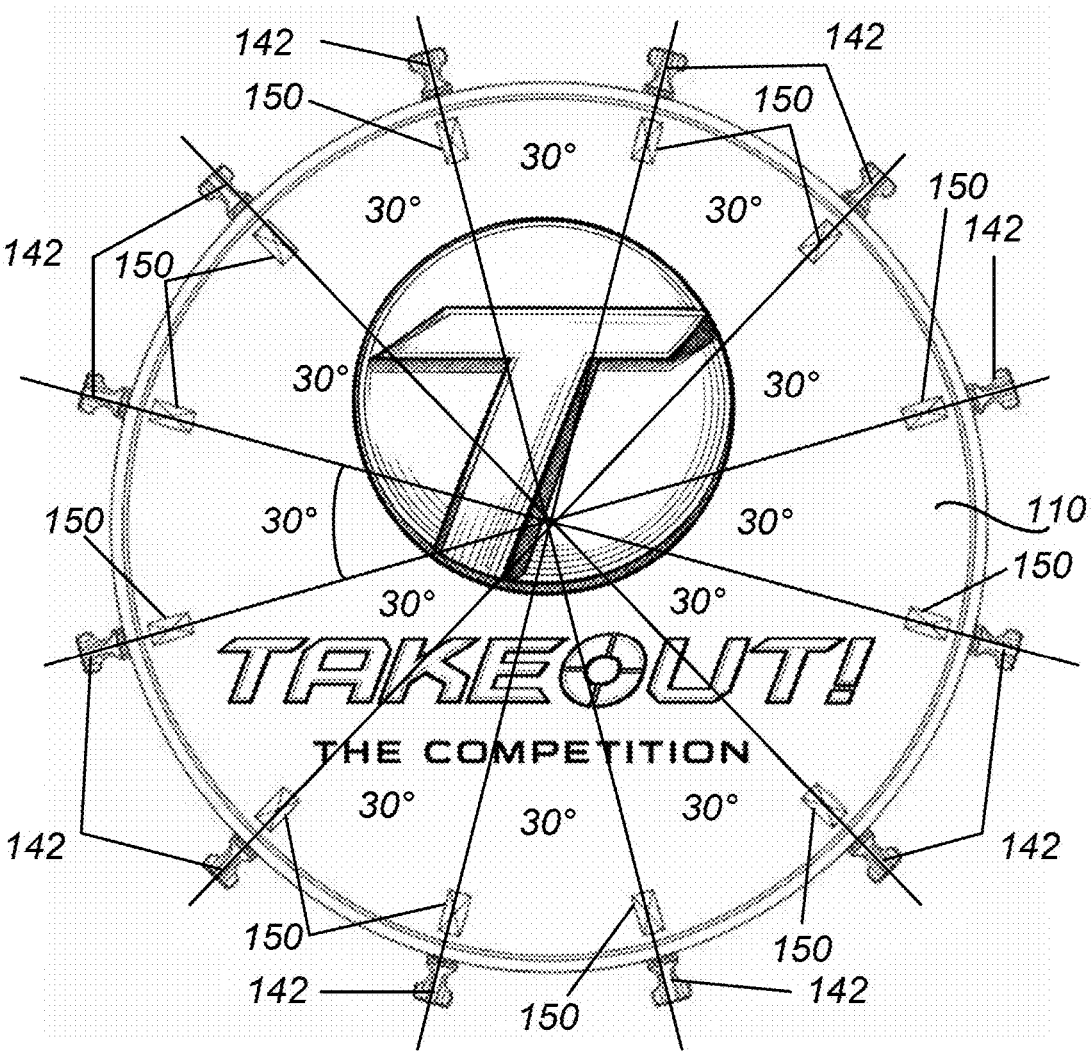
FIG. 3 illustrates one example of the inner hub with a plurality of cord fastener receiver configured around the perimeter for receiving a fastener receptacle from one or more divider cords, the fastener receptacle being attached to one end of the divider cord.

Referring to FIG. 3, there is illustrated one example of the inner hub 110 configured with a plurality of inner fasteners 142 distributed about a perimeter region of the inner hub 110 for selectively coupling one or more divider cords 114 to the inner hub 110, wherein the inner hub 110 is shown in a generally circular form-factor and includes the plurality of inner fasteners 142 arranged about the perimeter region.

In this manner, FIG. 3 illustrates the inner hub 110 as a flexible central component that not only serves as a coupling platform for a plurality of divider cords 114, but also provides a discrete, repeatable set of hub-side attachment locations via the plurality of inner fasteners 142, enabling in-game reconfiguration of playing section boundaries while maintaining a consistent hub-based reference for divider placement.

In the illustrated example, the inner hub fasteners 142 can be distributed substantially uniformly around a perimeter region of the inner hub 110. In an exemplary embodiment, the inner hub fasteners 142 can be positioned at angular increments of approximately thirty degrees of arc, such that the inner hub 110 provides twelve discrete hub-side attachment locations for coupling divider cords 114.

In other exemplary embodiments, the inner hub 110 can include at least eight inner hub fasteners 142 distributed about the perimeter region. In further exemplary embodiments, the inner hub 110 can include more than eight inner hub fasteners 142, such as to increase an available resolution for divider placement, to expand a number of permissible playing-section configurations, and or to improve repeatability when recreating a selected court geometry.

In an exemplary embodiment, the inner hub 110 can comprise a flexible sheet material, such as a woven textile, coated textile, polymer sheet, elastomeric sheet, laminated composite fabric, or other suitable flexible substrate, that provides a centralized coupling platform for the paddle ball court system 100. The inner hub 110 can be configured to remain generally planar relative to a playing surface during use while still providing compliance that allows the inner hub 110 to flex and conform to uneven ground, sand, turf, or other outdoor surfaces. In an exemplary embodiment, the inner hub 110 can include a perimeter reinforcement region such as a hemmed edge, doubled-over edge region, folded seam, and or a perimeter band that resists fraying and distributes tensile loads introduced by the divider cords. In one example, the perimeter region can include a circumferential webbing band stitched to the inner hub 110, where the webbing band provides a higher tensile strength load path around the inner hub perimeter and reduces localized tearing adjacent to the inner fasteners 142.

In an exemplary embodiment, each inner fastener 142 can be coupled to the inner hub 110 by a reinforced attachment structure configured to transmit repeated tension cycles into the inner hub 110 without localized material failure. For example, each inner fastener 142 can be carried by a short strap or tab that overlaps the inner hub 110 and is secured using a stitch pattern 150 such as a box stitch, bar tack, multi-pass stitch pattern, zig-zag stitch, or other reinforcement stitch configured to distribute load over a wider area of fabric. In an exemplary embodiment, the inner hub 110 can further include a local reinforcement patch behind each strap or tab, such as an additional fabric layer, an embedded scrim, a polymer backing plate, or a laminated stiffener region, which can reduce wrinkling and reduce peel forces at the fastener attachment region. In an exemplary embodiment, one or more of the inner fasteners 142 can be tethered to the inner hub 110 by a short flexible tether to reduce the likelihood of loss or to permit the fastener to be rotated or presented at a convenient angle for coupling.

In an exemplary embodiment, each inner fastener 142 can be configured as a hub-side receiver element of an interconnectable fastener pair 142/144, such that a cord fastener 144 coupled to a divider cord 114 is removably interconnected with a selected inner fastener 142 to couple the divider cord 114 to the inner hub 110. For example, the inner fastener 142 can comprise a buckle receiver, and the cord fastener 144 can comprise a mating buckle component, although the fasteners can alternatively comprise other removable coupling types. By way of non-limiting example, the inner fastener 142 can comprise at least one of: a side-release buckle receiver, a ladder-lock receiver, a cam buckle receiver, a loop, an eyelet, a ring, a D-ring, a grommeted strap loop, a hook-receiving bar, a carabiner-compatible loop, a snap socket, a magnetic coupler element, or another suitable receiver feature, and the corresponding cord fastener 144 can comprise a mating buckle component, hook, clip, snap stud, toggle, carabiner, or other mating connector configured to interconnect with the inner fastener 142.

In an exemplary embodiment, the inner fasteners 142 can be configured for rapid coupling and decoupling so that divider cords 114 can be repositioned during gameplay without tools. For example, a side-release buckle style can allow a user to actuate opposing release tabs to decouple the fastener pair 142/144, while a carabiner-loop style can allow a user to unclip and reclip a cord fastener 144 to a selected inner fastener 142. In an exemplary embodiment, the fastener geometry can be selected to resist unintended decoupling under tension while still enabling intentional release by a user, such as by requiring a two-direction motion, a squeeze-and-pull motion, or another deliberate release action.

In an exemplary embodiment, the arrangement of the plurality of inner fasteners 142 about the perimeter region of the inner hub 110 can provide discrete, indexed hub-side attachment locations that support repeatable court configurations. For example, when the divider cords 114 are used to divide the playing court into multiple playing sections, a player can select particular inner fasteners 142 that are angularly spaced so as to achieve two, three, four, or other numbers of playing sections, and can later return to the same fastener selection to recreate a prior configuration. In an exemplary embodiment, the inner hub 110 can be configured such that the plurality of inner fasteners 142 are substantially uniformly spaced, which can help establish symmetrical playing section layouts when desired, while still allowing asymmetric layouts by selecting non-symmetric fastener locations.

In an exemplary embodiment, the inner hub 110 can cooperate with the divider cords 114 and the rigid outer frame 102 to promote tautness and boundary determinability. For example, when multiple divider cords 114 are tensioned outward from selected inner fasteners 142, the inner hub 110 can distribute the resulting load vectors through the flexible sheet material and or through the perimeter reinforcement region, thereby reducing localized bunching and promoting predictable cord alignment. In an exemplary embodiment, the inner hub 110 can include one or more structural features that assist in load distribution, such as a circumferential reinforcement band, radial reinforcement strips, a laminated scrim layer, or an embedded fiber reinforcement, where such features can reduce stretch in selected directions and can maintain the inner fasteners 142 in intended relative positions under load.

In an exemplary embodiment, the inner hub 110 can include additional optional features that improve the usability and repeatability of court setup. For example, the inner hub 110 can include printed, stitched, embossed, or otherwise formed indexing markings adjacent the inner fasteners 142 to identify fastener positions, to indicate preferred fastener combinations for two-, three-, or four-player configurations, and or to provide visual confirmation that divider cords are installed at intended locations. In an exemplary embodiment, the inner hub 110 can further include a central graphic region, logo region, and or high-contrast marking region that assists players in locating the inner hub 110 relative to the rigid outer frame 102 during setup. In an exemplary embodiment, the inner hub 110 can also include drainage features or mesh regions to reduce water accumulation, and or abrasion-resistant coatings to improve durability when used on sand, turf, or hard surfaces.

Exemplary Gameplay Rules and Court Reconfiguration

In an exemplary embodiment, the paddle ball court system 100 can be configured to define a plurality of playing sections 116 for a multiplayer paddle-and-ball game. In an exemplary embodiment, the system 100 can comprise a rigid outer frame 102 configured to define an outer boundary of a playing court when assembled, and an inner hub 110 disposed within the outer boundary. In an exemplary embodiment, a plurality of inner fasteners 142 can be disposed about a perimeter region of the inner hub 110, and a plurality of elastically tensioned divider cords 114 can be provided to partition an interior play region 108 into the plurality of playing sections 116 arranged about the inner hub 110.

In an exemplary embodiment, each of the elastically tensioned divider cords 114 can have a first end removably coupleable to any selected inner fastener 142 and a second end removably coupleable to the rigid outer frame 102 at a selectable position along the rigid outer frame 102. In an exemplary embodiment, the first end can include a cord fastener 144 configured to removably interconnect with a selected inner fastener 142 to form an interconnectable fastener pair 142/144, and the second end can include a cord clip 146 configured to removably snap around an exterior surface of the rigid outer frame 102 at a selected attachment location. In an exemplary embodiment, each divider cord 114 can include an elastic cord portion configured to be stretched when installed so that the divider cord 114 remains taut and defines a visually determinable boundary segment between adjacent playing sections 116.

In an exemplary embodiment, the multiplayer paddle-and-ball game can be playable under one or more predefined gameplay rules. In an exemplary embodiment, the elastically tensioned divider cords 114 can remain taut during gameplay to provide visually determinable boundaries corresponding to the one or more predefined gameplay rules, including boundaries associated with in-bounds and out-of-bounds determinations for a playing section 116, boundaries associated with play restrictions between adjacent playing sections 116, and or boundaries associated with replay or fault conditions that are triggered by contact with a divider boundary.

In an exemplary embodiment, the system 100 can be configured to be reconfigured during gameplay, in response to a predefined gameplay condition, by relocating at least one of the elastically tensioned divider cords 114 to change at least one of (a) a number of the plurality of playing sections 116 and (b) a relative size of the plurality of playing sections 116 without disassembling the rigid outer frame 102. In an exemplary embodiment, relocating can include detaching a divider cord 114 from a first inner fastener 142 and reattaching the divider cord 114 to a different inner fastener 142 on the inner hub 110, and detaching the cord clip 146 from a first position along the rigid outer frame 102 and reattaching the cord clip 146 to a different selectable position along the rigid outer frame 102, thereby changing a divider boundary location while the rigid outer frame 102 remains assembled and deployed.

In an exemplary embodiment, the predefined gameplay condition can comprise elimination of a player from the multiplayer paddle-and-ball game. In this manner, when a player is eliminated, and the number of active players changes, the court can be reconfigured by relocating one or more divider cords 114 so that the playing sections 116 are updated for remaining players, while maintaining taut internal boundaries that remain visually determinable during continued play.

In an exemplary embodiment, the one or more predefined gameplay rules can include a replay condition when a game ball 122 contacts one of the elastically tensioned divider cords 114 forming a boundary between adjacent playing sections 116. In an exemplary embodiment, because the divider cords 114 can be maintained taut, contact between the game ball 122 and a divider boundary can be more readily observed and adjudicated, thereby promoting consistent application of the replay condition during gameplay.

In an exemplary embodiment, the one or more predefined gameplay rules can include a replay condition when a player's paddle 118 crosses a boundary plane defined by one of the elastically tensioned divider cords 114. In an exemplary embodiment, the divider cord 114 can define a boundary plane extending vertically upward from the divider cord 114, and crossing this boundary plane by a paddle 118 can be treated as a replay-triggering event, a fault, or another gameplay consequence depending on a selected ruleset.

In an exemplary embodiment, a method of using the paddle ball court system 100 can comprise initiating gameplay under rules in which points are not awarded on a serve and are not awarded on a second hit following the serve, awarding points starting on a third hit following the serve, eliminating a player upon the player reaching a predefined point threshold, and after eliminating the player, reconfiguring the playing court by detaching at least one elastically tensioned divider cord 114 and reattaching the at least one elastically tensioned divider cord 114 to change the number of playing sections 116 for remaining players while the rigid outer frame 102 remains assembled and deployed.

Figure 4:
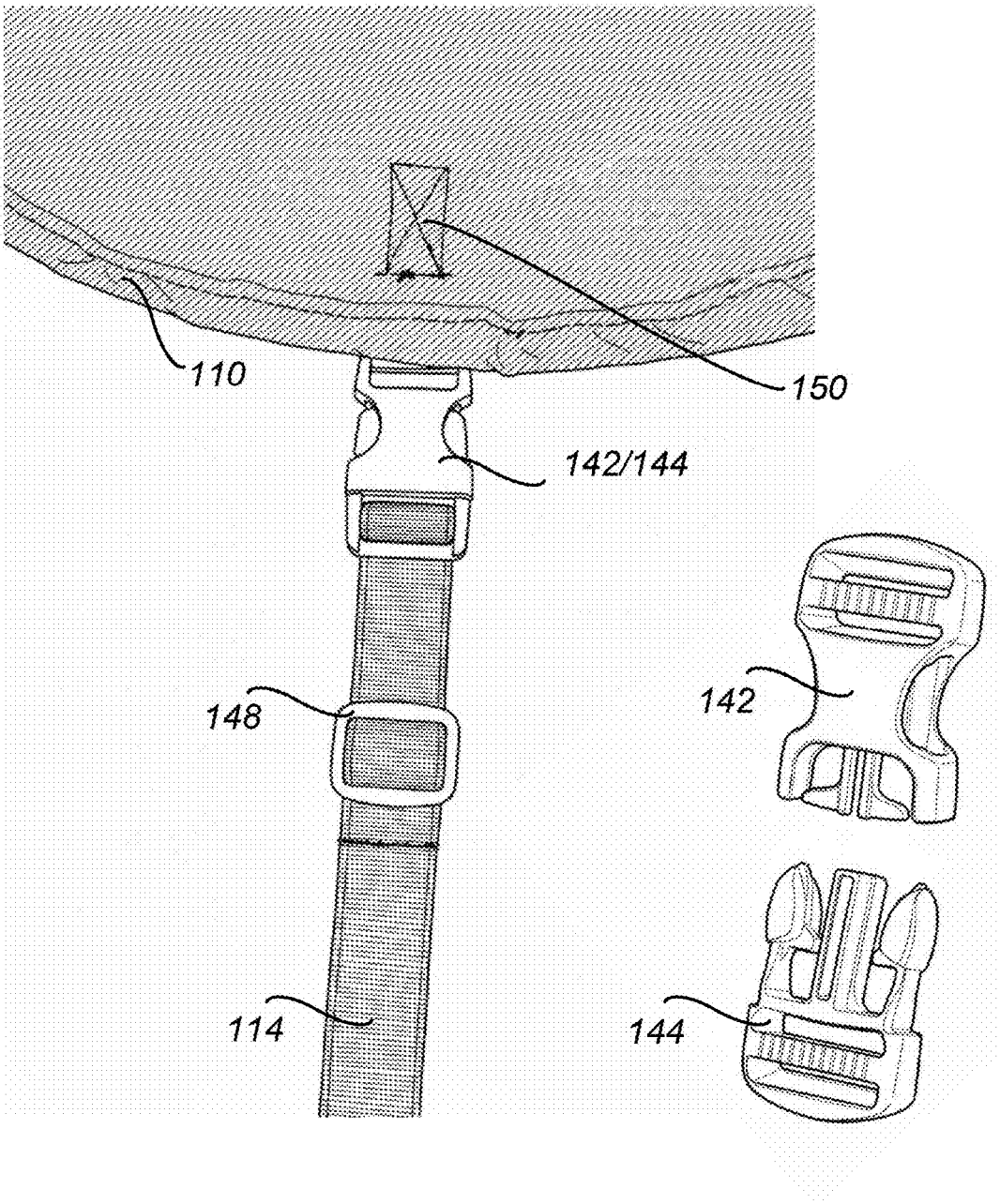
FIG. 4 illustrates one example of one end of a divider cord configured with a cord fastener, attached to the inner hub.

Referring to FIG. 4, there is illustrated one example of a hub-side coupling arrangement for removably attaching a divider cord 114 to the inner hub 110 using an interconnectable fastener pair 142/144, and further illustrating example length-management features for maintaining a taut divider cord 114 during gameplay. In the illustrated example, a hub-side inner hub fastener 142 can be coupled to the inner hub 110, and a cord-side cord fastener 144 can be coupled to the divider cord 114, where the divider cord 114 can be removably coupled to the inner hub 110 by interconnection of the fastener pair 142/144. In an exemplary embodiment, the inner hub fastener 142 can comprise a receiver-style buckle component, and the cord fastener 144 can comprise a mating buckle component, although other interconnectable fastener types can be used.

In an exemplary embodiment, the inner hub fastener 142 can be coupled to the inner hub 110 by a sewn attachment 150 that secures the inner hub fastener 142 to the inner hub 110 and provides a load path for transmitting tension from the divider cord 114 into the inner hub 110. For example, the sewn attachment 150 can include a stitched tab, folded webbing loop, tethered strap segment, or other reinforcement structure that distributes tensile forces over a broader region of the inner hub 110 and reduces localized tearing during repeated tension cycles and repeated coupling/decoupling during gameplay. In an exemplary embodiment, the sewn attachment 150 can be configured to orient the inner hub fastener 142 in a consistent direction relative to the perimeter of the inner hub 110, thereby making the fastener pair 142/144 quicker to locate and to reconnect during in-game reconfiguration.

In an exemplary embodiment, the divider cord 114 can comprise a strap, cord, webbing, elastic strap, bungee-style cord, braided elastic, or other suitable elongated tension member. The divider cord 114 can be routed through one or more slots or bars of the cord fastener 144 such that the divider cord 114 can be length-adjustable at the cord fastener 144. In this manner, a user can pull a free end portion of the divider cord 114 through the cord fastener 144 to shorten or lengthen an effective divider-cord length, which can assist in achieving a desired installed tension when the divider cord 114 is later coupled between the inner hub 110 and the rigid outer frame 102. In an exemplary embodiment, this adjustability can be used to tune tension based on a selected diameter of the rigid outer frame 102, a selected playing-section geometry, environmental conditions (e.g., sand compliance), and or user preference for boundary firmness.

In an exemplary embodiment, a strap retainer 148 can be disposed on the divider cord 114 and configured to retain a loose end portion of the divider cord 114 after adjustment. For example, after a user pulls the divider cord 114 through the cord fastener 144 to establish a desired effective length, the strap retainer 148 can constrain the remaining slack so that the loose end does not flap, drag, or interfere with gameplay. In an exemplary embodiment, retaining the loose end with the strap retainer 148 can also reduce unintended length changes by reducing migration of the strap through the cord fastener 144 during repeated impacts and tension cycles. In an exemplary embodiment, the strap retainer 148 can comprise a sliding keeper, a loop, a hook-and-loop keeper, an elastic band, a stitched keeper, or other suitable retainer structure.

Referring still to FIG. 4, an exploded view of the interconnectable fastener pair is illustrated, showing the inner hub fastener 142 and the cord fastener 144 as separate components that can be selectively interconnected. In an exemplary embodiment, the fastener geometry can be selected to enable rapid tool-less coupling and decoupling during gameplay while resisting unintended disengagement under tension. For example, the fastener pair 142/144 can be configured to require a deliberate release action, such as a squeeze-and-pull motion, while remaining secure during normal boundary loading from a taut divider cord 114. In an exemplary embodiment, the ability to removably connect the divider cord 114 to any selected inner hub fastener 142 using the cord fastener 144 can allow the divider cord 114 to be quickly relocated among different hub-side attachment locations on the inner hub 110, thereby supporting in-game reconfiguration of a number of playing sections and or a relative size of one or more playing sections while the court remains deployed.

In an exemplary embodiment, at least one divider cord 114 can be preferably implemented as a generally flat, elongated boundary member, such as a strap or webbing, so that the divider cord 114 presents a boundary segment having a width that is visually and physically discernible during gameplay. In this manner, when the divider cord 114 is elastically tensioned between the inner hub 110 and the rigid outer frame 102, the divider cord 114 can define a straight boundary segment that lies generally flat relative to a playing surface and is easier to visually judge for in-bounds and out-of-bounds conditions.

In an exemplary embodiment, the divider cord 114 can have a selected width that increases boundary visibility and reduces ambiguous calls caused by thin or rolling boundary members. By way of non-limiting example, the divider cord 114 can comprise webbing having a width of at least about 10 mm, and in further non-limiting examples can be about 15-50 mm wide, although other widths can be used. In an exemplary embodiment, the divider cord 114 can further include a contrasting color, a patterned region, a reflective thread, an edge stitch, or another visibility-enhancing feature so that a ball contact, landing position, and boundary adjacency can be determined more consistently by players and or officials.

In an exemplary embodiment, the divider cord 114 can be configured to resist twisting about its longitudinal axis while under tension so that the divider cord 114 remains generally flat during play. For example, the divider cord 114 can comprise a layered strap construction, a woven webbing having increased torsional stiffness, a stitched edge reinforcement, and or an internal stiffener strip disposed along at least a portion of the divider cord 114. In this manner, once tensioned, the divider cord 114 can maintain a repeatable boundary presentation that remains straight, flat, and wide across the interior play region 108 during normal play and during repeated impact and tension cycles.

Figure 5:
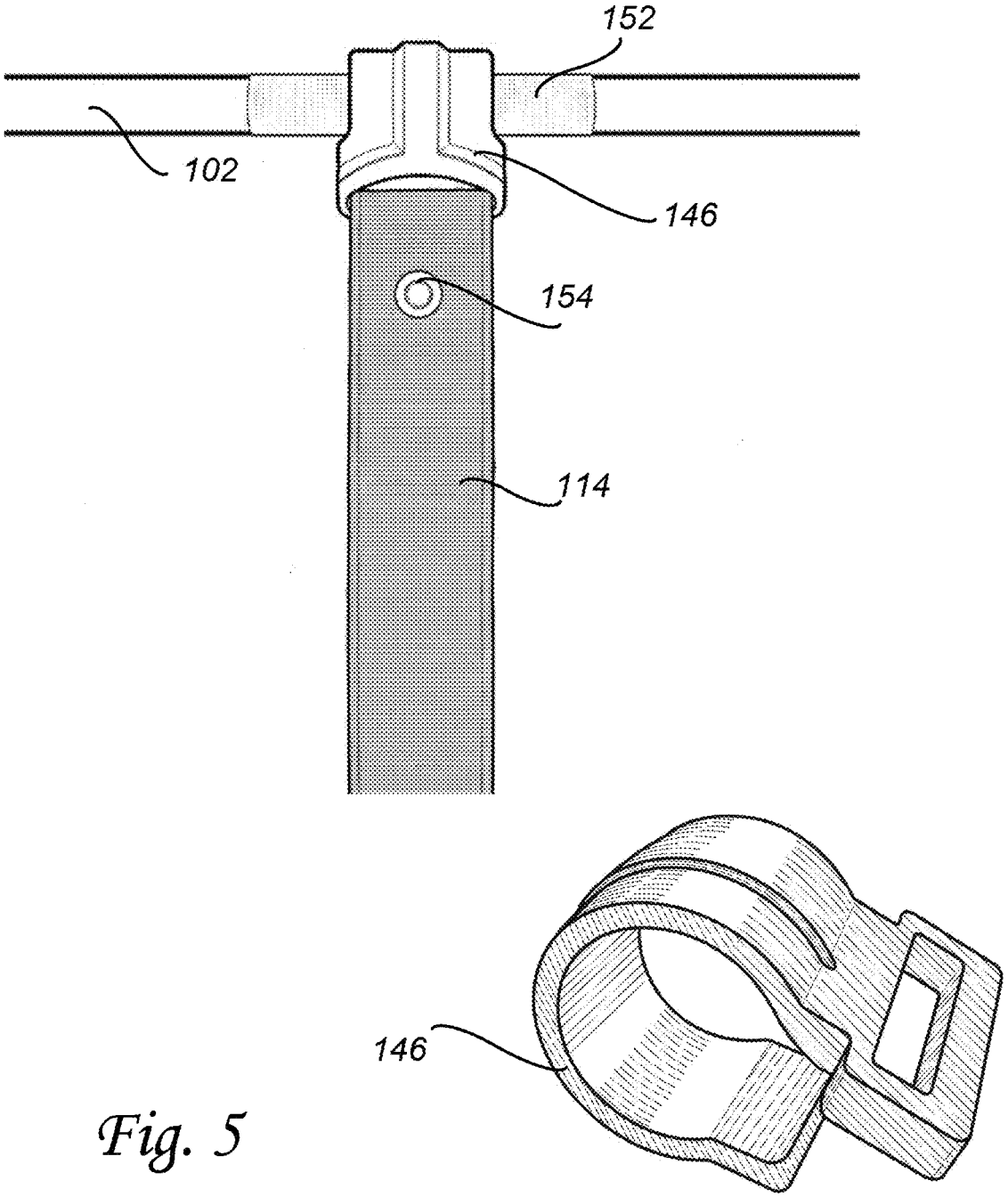
FIG. 5 illustrates one example of one end of a divider cord configured with a cord clip, being attached to the rigid outer frame.

Referring to FIG. 5, there is illustrated one example of an outer-end coupling arrangement in which a divider cord 114 is removably attached to a rigid outer frame 102 using a cord clip 146, and further illustrating one example of a friction marker attachment 152 configured to resist sliding and provide a visual placement indicator. In the illustrated example, the cord clip 146 can be configured to removably snap around an exterior surface of the rigid outer frame 102, such that an outer end of the divider cord 114 can be attached at a selectable attachment location along the rigid outer frame 102. In an exemplary embodiment, the cord clip 146 can include a resilient clip body defining a generally C-shaped capture region sized to receive a tubular portion of the rigid outer frame 102 in snap-fit engagement, where the clip body elastically deforms during installation over the rigid outer frame 102 and returns toward an undeformed state to retain the rigid outer frame 102. In an exemplary embodiment, the cord clip 146 can be configured to be installed and removed without tools, enabling rapid attachment, detachment, and relocation of the divider cord 114 to change a boundary position of a playing section while the rigid outer frame 102 remains assembled and deployed.

In an exemplary embodiment, the divider cord 114 can be coupled to the cord clip 146 by routing an end portion of the divider cord 114 through a cord-receiving feature of the cord clip 146, such as an aperture, slot, bar, or loop region, and retaining the routed end portion so the cord clip 146 remains secured to the divider cord 114 under tension. In the illustrated example, a divider cord attachment 154 can be provided to permanently attach the divider cord 114 to itself after looping through the cord clip 146, thereby forming a retained loop and preventing the divider cord 114 from unintentionally pulling free of the cord clip 146 during repeated tension cycles. In an exemplary embodiment, the divider cord attachment 154 can comprise a rivet, crimp, stitched joint, bar tack, weld, adhesive bond, or other suitable permanent attachment structure, and can be positioned to establish a repeatable end geometry that presents the cord clip 146 in a consistent orientation for snap engagement with the rigid outer frame 102.

Referring still to FIG. 5, one or more friction marker attachments 152 can be disposed on the rigid outer frame 102 at one or more locations. In an exemplary embodiment, each friction marker attachment 152 can be configured to increase friction between the cord clip 146 and the rigid outer frame 102 so as to abate sliding of the cord clip 146 along the rigid outer frame 102 when the divider cord 114 is tensioned. For example, the friction marker attachment 152 can comprise a tape segment, textured coating, elastomeric sleeve, overmolded patch, knurled region, or other friction-enhancing feature applied to the rigid outer frame 102. In an exemplary embodiment, the friction marker attachment 152 can additionally serve as a visual indicator that guides players to preferred attachment locations for the cord clip 146, which can promote repeatable court setup and consistent placement of divider boundaries when recreating a selected playing configuration. In an exemplary embodiment, the friction marker attachments 152 can be positioned at locations that correspond to commonly used playing-section geometries, thereby enabling a player to quickly reposition the cord clip 146 to a known reference location while maintaining tension in the divider cord 114.

Additional Exemplary System and Method Embodiments

In an exemplary embodiment, the cooperative relationship between the cord clip 146, the friction marker attachment 152, the divider cord attachment 154, and the rigid outer frame 102 can support a divider cord 114 that remains coupled and generally taut during gameplay, while still permitting the divider cord 114 to be detached and reattached at different selectable positions along the rigid outer frame 102 as part of an in-game court reconfiguration.

In an exemplary embodiment, the friction marker attachments 152 can be configured not only to increase friction, but also to provide discrete, indexed attachment positions for the cord clip 146 along the rigid outer frame 102. For example, each friction marker attachment 152 can comprise a locally raised region, sleeve, bump, knurled patch, or other surface feature that a cord clip 146 can seat against, such that the cord clip 146 is inhibited from migrating circumferentially along the rigid outer frame 102 under divider-cord tension.

In an exemplary embodiment, the cord clip 146 can include a complementary indexing geometry configured to cooperate with a friction marker attachment 152, such as a notch, pocket, rib, or interference shoulder that engages the friction marker attachment 152 when the cord clip 146 is installed. In this manner, the combination of the friction marker attachments 152 and the cord clips 146 can provide repeatable divider-cord perimeter endpoints that enable users to recreate standardized court geometries, including configurations suited for organized competitive play as well as recreational play.

In an exemplary embodiment, the inner hub 110 can include visual and or tactile indexing features corresponding to the plurality of inner fasteners 142 positioned at approximately 30° increments. For example, the inner hub 110 can include printed markings, embossed numerals, tick marks, arrows, and or color indicators adjacent to respective inner fasteners 142 so that a user can quickly select a desired one of the twelve discrete hub-side attachment locations and can repeat the same selection in subsequent matches.

In an exemplary embodiment, the rigid outer frame 102 can similarly include visual and or tactile indexing features corresponding to friction marker attachments 152 positioned along the rigid outer frame 102. For example, the friction marker attachments 152 can include printed markings, embossed numerals, tick marks, arrows, and or color indicators at or adjacent to respective friction marker attachments 152 so that a user can quickly identify preferred cord clip 146 attachment locations and can repeat the same perimeter selections in subsequent matches. In an exemplary embodiment, the color indicators can be assigned to correspond to different court configurations or numbers of playing sections 116, such as a first color scheme indicating cord clip 146 placement locations for a two-section configuration, a second color scheme indicating placement locations for a three-section configuration, a third color scheme indicating placement locations for a four-section configuration, and so on, thereby enabling rapid and repeatable setup and reconfiguration of the paddle ball court system 100 during gameplay.

In an exemplary embodiment, the inner hub 110 can further include a configuration guide that correlates particular inner fastener 142 selections with particular perimeter attachment locations on the rigid outer frame 102, such as at friction marker attachments 152, to facilitate rapid setup of repeatable two-player, three-player, and four-player court configurations. In this manner, the inner hub 110 can function as a central reference that supports consistent angular divider placement while the rigid outer frame 102 supports consistent perimeter placement, thereby enabling repeatable playing section geometries when a selected configuration is recreated.

In an exemplary embodiment, the paddle ball court system 100 can be configured to provide repeatable, visually determinable section boundaries by technical cooperation between the rigid outer frame 102, the inner hub 110, and the divider cords 114. In an exemplary embodiment, each divider cord 114 can be elastically tensioned between a selected inner fastener 142 on the inner hub 110 (e.g., via an interconnectable fastener pair 142/144) and a selectable attachment location along the rigid outer frame 102 (e.g., via a cord clip 146), such that the divider cord 114 remains taut and defines a straight boundary segment across the interior play region 108. In an exemplary embodiment, at least one divider cord 114 can be implemented as a generally flat elongated boundary member, such as a strap or webbing, so the divider cord 114 presents a boundary segment having a width that is more readily perceivable by players and or officials, thereby improving consistency in judging in-bounds and out-of-bounds conditions relative to a playing section 116. In an exemplary embodiment, the rigid outer frame 102 can include friction marker attachments 152 that both abate sliding of the cord clip 146 under tension and provide discrete, indexed perimeter attachment positions to enable repeatable perimeter endpoints for divider placement, including standardized configurations suitable for organized competitive play as well as recreational play. In an exemplary embodiment, the inner hub 110 can include at least twelve inner fasteners 142 spaced at approximately thirty-degree of arc increments around a perimeter region of the inner hub 110, and can optionally include visual and or tactile indexing features associated with respective inner fasteners 142 to assist users in rapidly selecting repeatable hub-side attachment locations, such that a selected playing-section configuration can be recreated with consistent geometry by selecting corresponding hub-side inner fasteners 142 and perimeter-side attachment locations along the rigid outer frame 102 (e.g., at selected friction marker attachments 152).

In an exemplary embodiment, the rigid outer frame 102 can include a plurality of friction marker attachments 152 positioned circumferentially around the rigid outer frame 102 to provide both friction-enhanced seating locations for the cord clip 146 and repeatable, indexed placement guidance for configuring playing section 116 geometry. In the illustrated example, the friction marker attachments 152 can be distributed substantially uniformly about the rigid outer frame 102. In an exemplary embodiment, the rigid outer frame 102 can include thirty-six friction marker attachments 152 equally positioned around the rigid outer frame 102, such that adjacent friction marker attachments 152 are separated by approximately ten degrees of arc around the rigid outer frame 102, although other quantities and angular spacings can be used.

In an exemplary embodiment, this higher-resolution perimeter indexing provided by the friction marker attachments 152 can cooperate with the plurality of inner fasteners 142 on the inner hub 110 to enable repeatable perimeter endpoints for divider placement while still allowing fine adjustment of playing section 116 size and boundary orientation. For example, while the inner hub 110 can include twelve inner fasteners 142 spaced at approximately thirty-degree of arc increments, the thirty-six friction marker attachments 152 can provide three selectable perimeter attachment positions for each thirty-degree of arc hub increment, thereby allowing a user to select among multiple different perimeter endpoints for a divider cord 114 that is coupled to a given inner fastener 142. In this manner, a user can quickly establish common standardized court configurations, can intentionally bias section size for competitive balancing, and or can reproduce a preferred configuration by repeatedly selecting the same combination of inner fastener 142 location and friction marker attachment 152 location.

In an exemplary embodiment, each friction marker attachment 152 can comprise a tape segment, textured coating, elastomeric sleeve, overmolded patch, knurled region, locally raised feature, or other friction-enhancing surface applied to the rigid outer frame 102 to abate sliding of the cord clip 146 under tension applied by the divider cord 114. In an exemplary embodiment, the cord clip 146 can seat on or against a selected friction marker attachment 152, and the friction marker attachment 152 can optionally include visual indicia (e.g., tick marks, numerals, and or color coding) to guide users to repeatable clip attachment locations associated with particular playing-section 116 configurations.

In other exemplary embodiments, the rigid outer frame 102 can include one or more friction marker attachments 152 positioned at one or more locations along the rigid outer frame 102 to provide friction-enhanced and repeatable perimeter attachment regions for cord clips 146 and to abate clip sliding under divider-cord tension. In further exemplary embodiments, the friction marker attachments 152 can comprise any selected number of friction marker attachments 152 distributed along the rigid outer frame 102 in a substantially uniform pattern, a non-uniform pattern, and or a pattern corresponding to one or more predetermined court configurations. In an exemplary embodiment, the number and spacing of the friction marker attachments 152 can be selected to provide a desired placement resolution for divider cord 114 perimeter endpoints, to guide players in rapidly establishing repeatable playing section 116 geometries, and or to enable fine adjustment of playing section 116 size and boundary orientation while the rigid outer frame 102 remains assembled and deployed.

Figure 6:
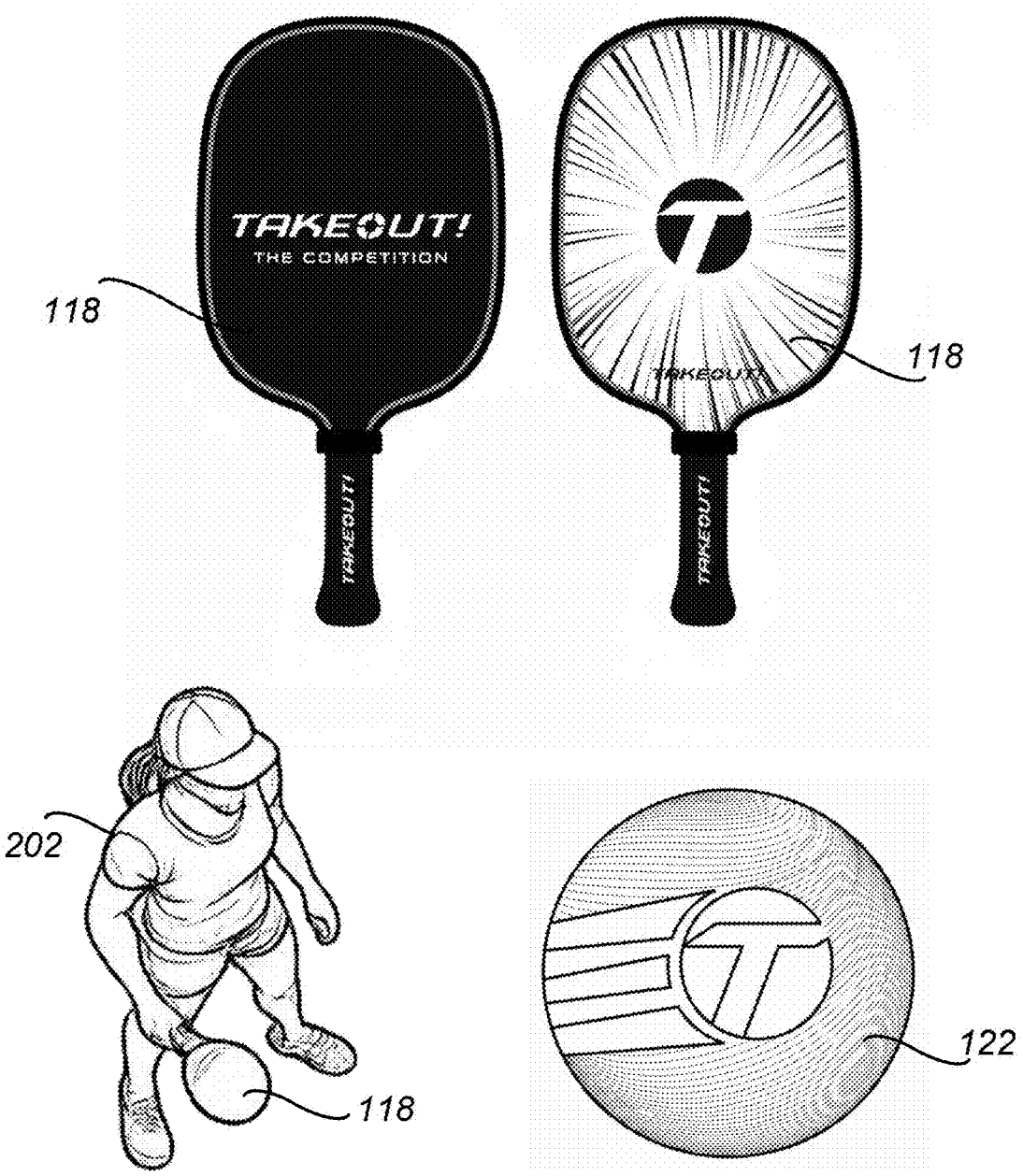
FIG. 6 illustrates one example of the game paddles and the game ball, each of which are used by the players to play the game.

Referring to FIG. 6, there is illustrated one example of game equipment that can be used with the reconfigurable paddle ball court system 100, including one or more paddles 118 and a game ball 122. In the illustrated example, each paddle 118 can include a handle portion configured for a user to grip and a paddle face portion configured to contact the game ball 122 during play. In an exemplary embodiment, the paddle 118 can be configured to provide controlled rebound and directional placement of the game ball 122, such as by employing a selected paddle-face stiffness, thickness, surface texture, and or edge geometry that promotes predictable contact behavior. For example, the paddle face can comprise a rigid polymer, composite, wood, or other suitable structural material, and can optionally include a surface coating, surface texture, or friction-enhancing layer configured to increase control of ball trajectory, including underhanded strikes, lateral deflections, or upward trajectory shots.

In an exemplary embodiment, the game ball 122 can be selected to provide a desired bounce profile and flight behavior when struck by the paddle 118 and when contacting a playing surface. For example, the game ball 122 can comprise a hollow elastomeric ball, a foam ball, a rubber ball, or another suitable ball type having a selected diameter, mass, and elasticity. In an exemplary embodiment, the game ball 122 can be configured to maintain consistent bounce on varying outdoor surfaces such as sand, grass, turf, or packed soil, and can be sized such that it can be reliably struck and returned by players without excessive velocity, thereby supporting sustained rallies and controlled placement within playing sections defined by divider cords 114 and the rigid outer frame 102.

In an exemplary embodiment, the paddles 118 and the game ball 122 can be provided as part of a kit associated with the paddle ball court system 100, such that the game can be deployed as a complete set. For example, the kit can include a plurality of paddles 118 corresponding to a maximum player count supported by the court system 100, and can include one or more game balls 122, including spare balls. In an exemplary embodiment, providing standardized paddles 118 and standardized game balls 122 can promote repeatable play characteristics across different deployments of the system 100, which can be desirable for structured play formats such as leagues or tournaments where consistency of equipment can improve competitive fairness.

In an exemplary embodiment, the illustrated game equipment can be selected and or configured to cooperate with the taut divider-cord boundaries and repeatable perimeter geometry of the rigid outer frame 102 so that gameplay decisions, such as whether a ball is in-bounds or out-of-bounds or whether a shot is playable after contacting a boundary, can be made more consistently by players.

Figure 7:
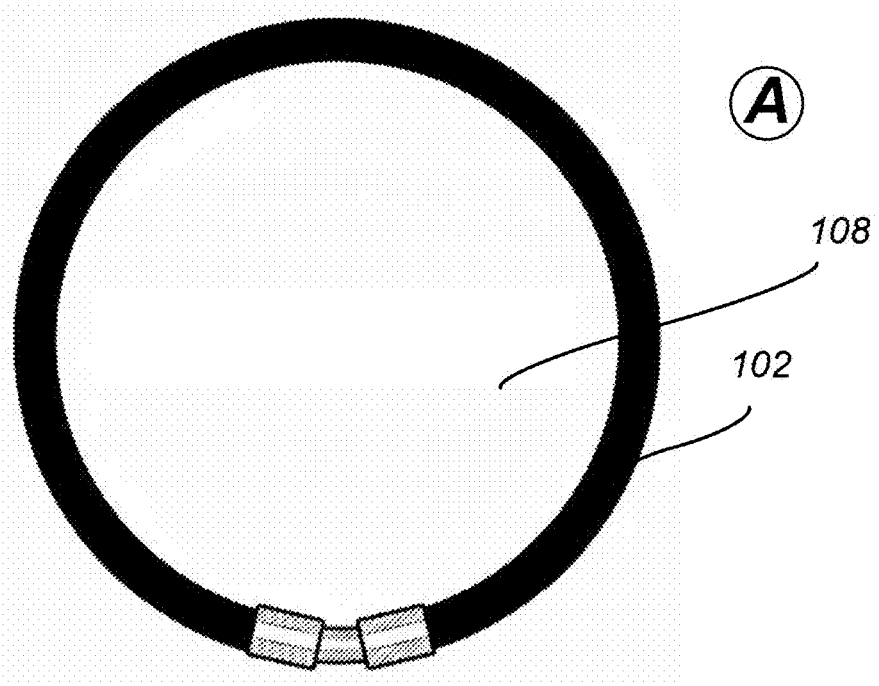
FIG. 7 illustrates one example of, in reference 'A', an assembled outer frame, creating an inner play area, such outer frame can be a single rod structure coupled together or, as illustrated in reference 'B', created from more than one rod segment that can be assembled together to create the rigid outer frame.
Figure 7:
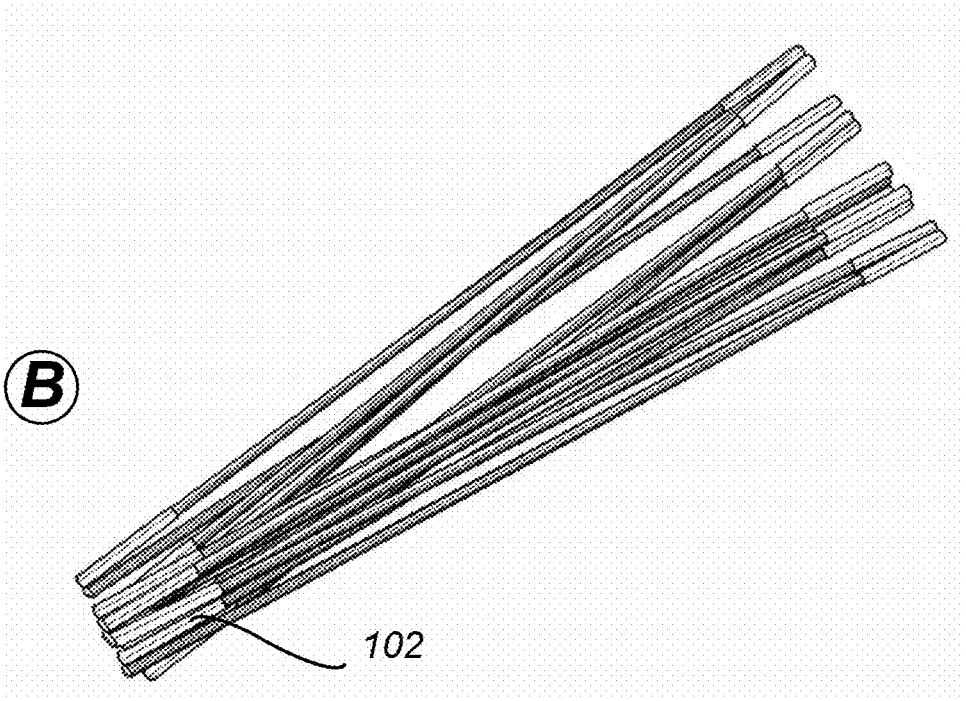

Referring to FIG. 7, there is illustrated one example of the rigid outer frame 102 in an assembled configuration and in a segmented configuration for assembly, transport, and storage. In reference 'A', the rigid outer frame 102 is shown in an assembled state, defining an outer boundary of the playing court. In an exemplary embodiment, when assembled, the rigid outer frame 102 can maintain a repeatable perimeter geometry that provides a visually determinable outer boundary for gameplay, including for determining in-bounds and out-of-bounds conditions relative to the playing court. In an exemplary embodiment, the rigid outer frame 102 can define a generally circular perimeter, although other closed-loop perimeter shapes can be used, such as an oval, a rounded polygon, or other continuous boundary geometry.

In an exemplary embodiment, the rigid outer frame 102 can be formed from a single, continuous rod that is joined end-to-end to form a closed loop, such as by a coupling sleeve, an internal ferrule, a connector insert, a threaded coupler, a spring-button coupler, or other suitable end-joining structure. For example, a first end of the rod can be configured to mate with a second end of the rod to define a continuous ring structure, and the joining structure can be selected to resist separation under normal gameplay forces and under tension applied by the divider cords 114 when installed. In an exemplary embodiment, the rod can be sufficiently rigid in the assembled configuration to resist appreciable perimeter distortion during gameplay while still being sufficiently resilient to permit controlled flexing during transport and storage.

Referring still to FIG. 7, reference 'B' illustrates one example in which the rigid outer frame 102 is formed from a plurality of rod segments that can be assembled together to create the assembled rigid outer frame 102 shown in reference A. In an exemplary embodiment, each rod segment can include a coupling interface at one or both ends, such as an internal ferrule, an external sleeve, a tapered insert, a snap-button joint, a threaded joint, a twist-lock joint, or other suitable segment coupling. In an exemplary embodiment, the segment coupling can be configured to provide axial retention and rotational alignment such that, when assembled, the plurality of segments cooperatively define the repeatable perimeter geometry of the rigid outer frame 102. In an exemplary embodiment, segmenting the rigid outer frame 102 can reduce the longest packed length of the system for storage and transport, while still enabling an assembled perimeter that is rigid during gameplay.

In an exemplary embodiment, the rigid outer frame 102 can be formed from a material selected to provide an appropriate balance of stiffness, toughness, corrosion resistance, and weight for outdoor use. By way of non-limiting example, the rigid outer frame 102 can comprise at least one of: fiberglass (including solid fiberglass rod or fiberglass composite tubing), carbon fiber composite tubing, aluminum tubing, spring steel, stainless steel, reinforced polymer, or other suitable rod or tube material. In an exemplary embodiment, the rigid outer frame 102 can have a generally circular cross-section and can be sized so that cord clips 146 can snap-fit around the rigid outer frame 102 at selectable locations. By way of non-limiting example, the rigid outer frame 102 can have an outer diameter in a range of about 0.25 inches to about 1.0 inches, and in some embodiments about 0.375 inches to about 0.75 inches, although other sizes can be used depending on desired stiffness, portability, and the size of the cord clip 146. In an exemplary embodiment, the wall thickness of a tubular rigid outer frame 102 can be selected to provide sufficient rigidity, such as about 0.03 inches to about 0.12 inches, although other thicknesses can be used.

In an exemplary embodiment, the rigid outer frame 102 can be configured such that, when disassembled (in the segmented embodiment) or when released from its joined closed-loop form (in the single-rod embodiment), the rod or rod segments can be coiled or folded into a smaller loop diameter to facilitate storage. For example, a continuous fiberglass rod embodiment can be elastically deformed from an assembled large-diameter ring to a smaller multi-loop coil for packing, and can be retained in the packed configuration by a strap, sleeve, tie, or other retainer. In an exemplary embodiment, a segmented embodiment can be disassembled into multiple straight or slightly curved segments and placed in a carrying bag. In either case, the rigid outer frame 102 can be configured to be stored in a carrying bag 124 while maintaining sufficient stiffness in the assembled configuration for gameplay.

In an exemplary embodiment, the diameter of the assembled rigid outer frame 102 can be selected based on a desired court size and a desired gameplay spacing between players. By way of non-limiting example, the assembled rigid outer frame 102 can define a court diameter in a range of about 6 feet to about 16 feet, and in some embodiments about 8 feet to about 14 feet, although other court sizes can be used. In an exemplary embodiment, different sets of divider cords 114 can be provided to accommodate different outer frame diameters, and the divider cords 114 can include length-adjustment features (e.g., cord fasteners 144 and strap retainers 148) to tune tension based on a selected outer frame diameter.

In this manner, FIG. 7 illustrates that the rigid outer frame 102 can be implemented as a single-rod closed-loop structure or as a multi-segment structure that assembles into a closed-loop boundary, and can be configured for repeatable perimeter geometry during gameplay while remaining portable for storage and transport in the carrying bag 124.

Figure 8:
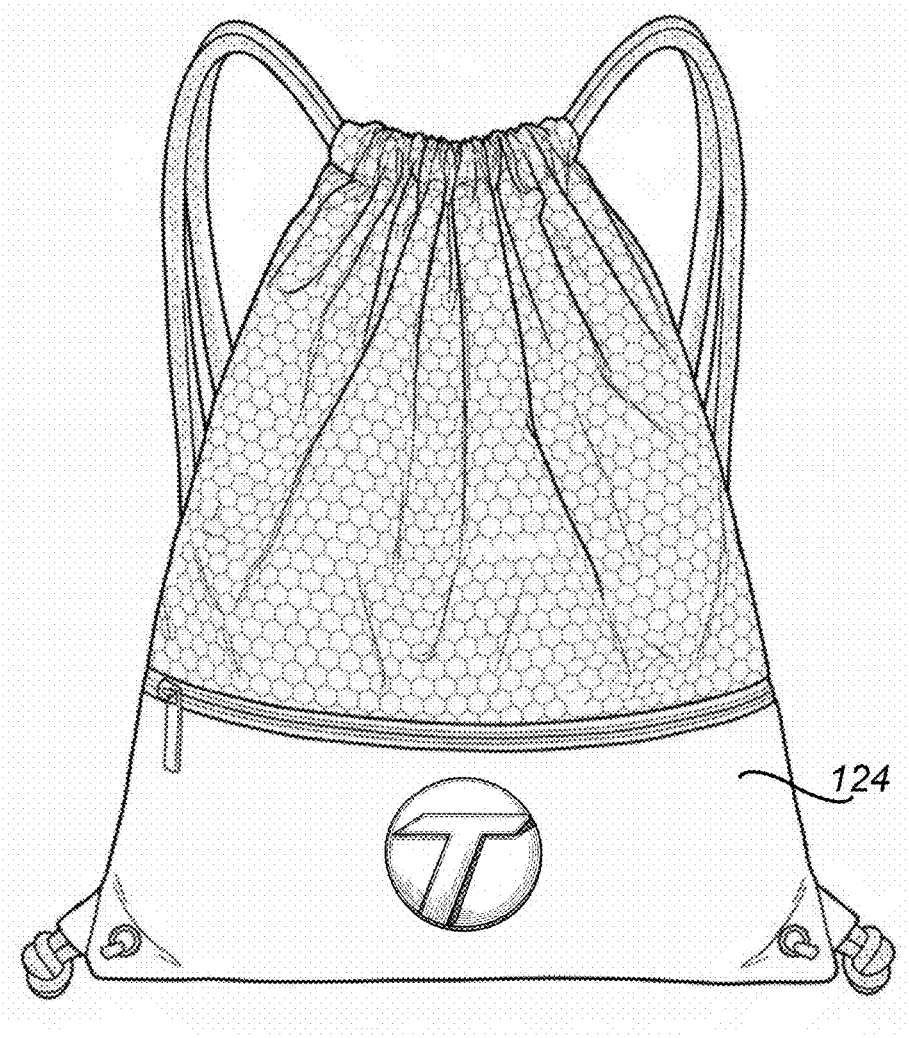
FIG. 8 illustrates one example of a bag used for carrying and storing the paddleboard court system.

Referring to FIG. 8, there is illustrated one example of a carrying bag 124 configured for storage and transport of the reconfigurable paddle ball court system 100 and associated kit components. In an exemplary embodiment, the carrying bag 124 can be sized and shaped to receive the rigid outer frame 102 in a disassembled segmented form (as shown in FIG. 7, reference B), and or in a folded or coiled form when the rigid outer frame 102 comprises a resilient continuous rod. In an exemplary embodiment, the carrying bag 124 can include a closure feature such as a zipper, hook-and-loop closure, buckle strap, drawstring, flap, or other suitable closure to retain the contents during transport, as well as one or more handles and or shoulder straps to enable a user to carry the system to a deployment location.

In an exemplary embodiment, the carrying bag 124 can be part of a kit that includes the primary court-defining components and the gameplay components used by players. For example, the kit can include the rigid outer frame 102, the inner hub 110, a plurality of divider cords 114, and one or more accessories used to install and reconfigure the divider cords 114 relative to the rigid outer frame 102 and the inner hub 110. In an exemplary embodiment, the kit can further include a plurality of paddles 118 and at least one game ball 122, such that the system can be deployed as a complete set for immediate play upon assembly.

In an exemplary embodiment, the carrying bag 124 can further include one or more internal compartments, sleeves, straps, and or retention features that keep the kit organized and that reduce tangling or damage of the divider cords 114. For example, the carrying bag 124 can include a cord compartment configured to store the divider cords 114 in a coiled state, where the cord compartment reduces twisting and facilitates rapid retrieval during setup. In an exemplary embodiment, the carrying bag 124 can include a dedicated pocket configured to store the inner hub 110 in a folded state, such as to prevent abrasion of the inner hub 110 and the inner hub fasteners 142 during transport. In an exemplary embodiment, the carrying bag 124 can include one or more paddle pockets configured to store paddles 118 in a stacked orientation, and a ball pocket configured to store one or more game balls 122.

In an exemplary embodiment, the kit can include spares and configuration aids that support repeatable deployment and reconfiguration of the court. For example, the kit can include spare divider cords 114, spare cord clips 146, spare cord fasteners 144, and or spare inner hub fasteners 142, and or repair components such as replacement strap retainers 148 or replacement friction marker attachments 152. In an exemplary embodiment, the kit can further include a configuration guide, printed card, or other instruction medium that identifies recommended divider placements and perimeter attachment locations for common playing-section configurations, thereby enabling a user to quickly establish a desired court geometry and to reconfigure the court as gameplay progresses.

In an exemplary embodiment, the carrying bag 124 can be formed from a durable fabric material such as nylon, polyester, canvas, coated textile, or other suitable bag material, and can include reinforcement stitching at high-load regions such as handle attachments and zipper ends. In an exemplary embodiment, the carrying bag 124 can be configured to protect the rigid outer frame 102 and other components from environmental exposure during transport, such as by including a water-resistant coating or liner. In an exemplary embodiment, the carrying bag 124 can be dimensioned to comply with common vehicle storage constraints and or travel constraints, thereby facilitating portability of the court system 100 for recreational use as well as organized events.

In this manner, FIG. 8 illustrates one example of a carrying bag 124 that enables the reconfigurable paddle ball court system 100 to be packaged as a portable kit, including the rigid outer frame 102, the inner hub 110, the divider cords 114, and optionally the paddles 118 and the game ball 122, thereby supporting consistent inventory, transport, deployment, and reconfiguration of the system for gameplay.

Figure 9:
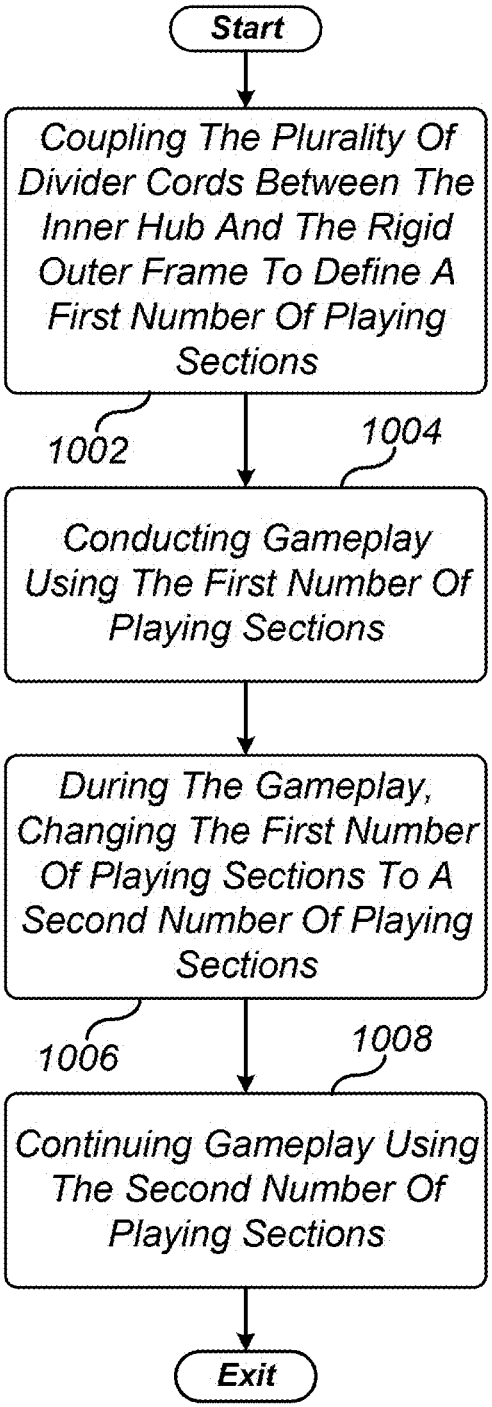
FIGS. 9-11 illustrate examples of gameplay.

Referring to FIG. 9, there is illustrated one example of a gameplay method flowchart for reconfiguring a deployed playing court from a first number of playing sections to a second number of playing sections during gameplay.

In step 1002, a player can couple a plurality of divider cords 114 between an inner hub 110 and a rigid outer frame 102 to define a first number of playing sections 116 within an interior play region 108.

In an exemplary embodiment, coupling can include removably interconnecting a cord-side cord fastener 144 on a selected divider cord 114 to a selected inner fastener 142 on the inner hub 110, and removably attaching an outer end of the divider cord 114 to the rigid outer frame 102 at a selectable attachment location (e.g., via a cord clip 146). In an exemplary embodiment, one or more divider cords 114 can be elastically tensioned when installed so the divider cords 114 are maintained taut to form visually determinable boundary segments that partition adjacent playing sections 116.

In step 1004, gameplay can be conducted using the first number of playing sections 116 while the rigid outer frame 102 remains assembled and deployed.

In an exemplary embodiment, the taut divider cords 114 can provide straight, visually determinable internal boundaries, which can improve consistency in judging whether a game ball 122 is in-bounds or out-of-bounds relative to a playing section 116 and the rigid outer frame 102, including during faster exchanges where boundary ambiguity can otherwise increase.

In step 1006, during gameplay, the first number of playing sections 116 can be changed to a second number of playing sections 116 by detaching at least one divider cord 114 and reattaching the at least one divider cord 114 to a different inner fastener 142 and to a different attachment location along the rigid outer frame 102, such that the second number of playing sections 116 is different than the first number of playing sections 116.

In an exemplary embodiment, detaching can include disengaging the cord fastener 144 from the inner fastener 142 and releasing the cord clip 146 from the rigid outer frame 102, and reattaching can include engaging the cord fastener 144 with a different inner fastener 142 and snapping the cord clip 146 onto a different location along the rigid outer frame 102. In an exemplary embodiment, one or more friction marker attachments 152 can optionally be used as placement indicators and or friction-enhancement regions to help a player quickly relocate the cord clip 146 to a repeatable position and abate clip migration under tension.

In step 1008, gameplay can be continued using the second number of playing sections 116 after reconfiguration, while the rigid outer frame 102 remains assembled and deployed.

In an exemplary embodiment, because the divider cords 114 can be detached and reattached without disassembling the rigid outer frame 102, reconfiguration can be performed rapidly enough to preserve match flow, and the same system can support multiple court configurations that can be selectively established as play progresses.

Figure 10:
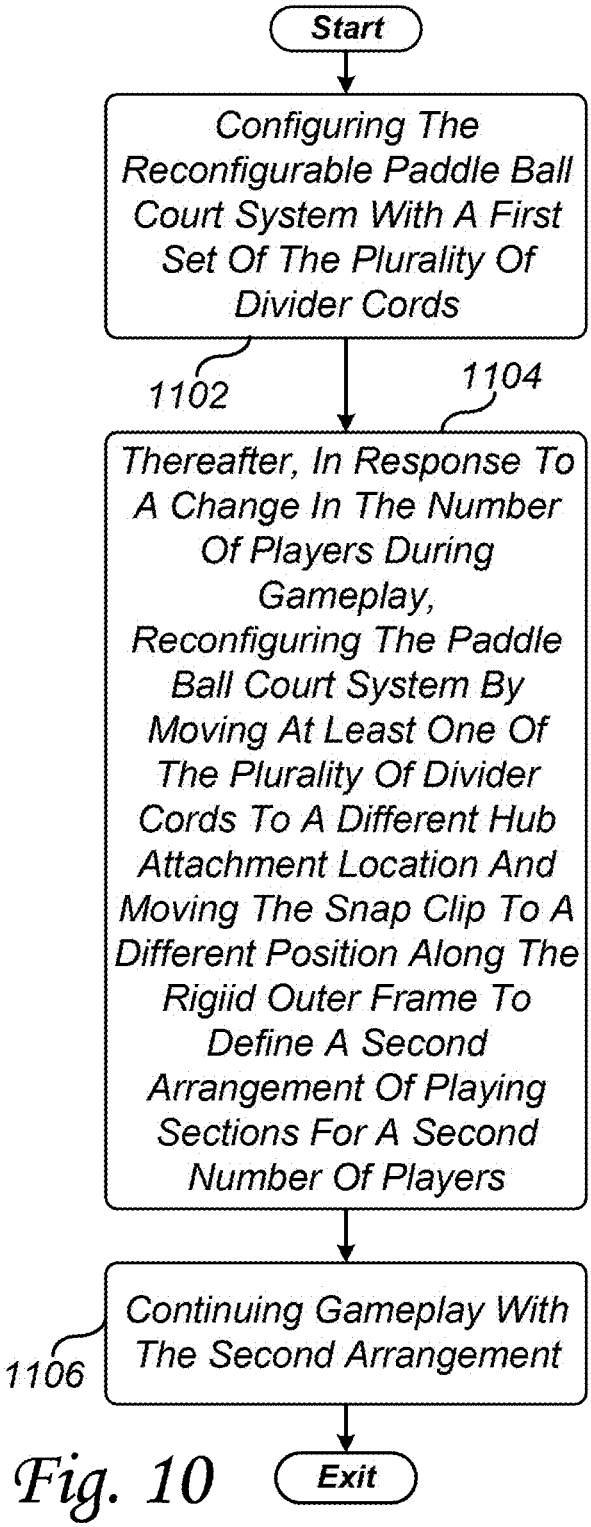

Referring to FIG. 10, there is illustrated one example of a gameplay method flowchart for reconfiguring the reconfigurable paddle ball court system in response to a change in player count during gameplay.

In step 1102, a player can configure the reconfigurable paddle ball court system 100 with a first set of a plurality of divider cords 114 to define a first arrangement of playing sections 116 for a first number of players.

In an exemplary embodiment, configuring can include selecting particular hub attachment locations on an inner hub 110 (e.g., selecting among a plurality of inner fasteners 142) for the first ends of the divider cords 114, and selecting perimeter attachment locations along a rigid outer frame 102 for the outer ends of the divider cords 114 (e.g., by snapping cord clips 146 at desired positions). In an exemplary embodiment, a first arrangement can be selected to provide a desired number of playing sections 116 and or a desired distribution of playing-section sizes for the first number of players.

In step 1104, thereafter, in response to a change in the number of players during gameplay, the reconfigurable paddle ball court system 100 can be reconfigured by moving at least one of the plurality of divider cords 114 to a different hub attachment location and moving a snap clip to a different position along the rigid outer frame 102 to define a second arrangement of playing sections for a second number of players.

In an exemplary embodiment, moving a divider cord 114 to a different hub attachment location can include disengaging a cord fastener 144 from a first inner fastener 142 on the inner hub 110 and re-engaging the cord fastener 144 with a different inner fastener 142. In an exemplary embodiment, moving the snap clip can include releasing a cord clip 146 from a first location on the rigid outer frame 102 and snapping the cord clip 146 onto a second location on the rigid outer frame 102, thereby changing an angular direction and or an effective span of the divider cord 114 so that the second arrangement yields a different number of playing sections 116 and or different playing-section geometry appropriate for the second number of players. In an exemplary embodiment, one or more friction marker attachments 152 can optionally be used to guide repeatable placement of the cord clip 146 and to abate sliding of the cord clip 146 along the rigid outer frame 102 under tension.

In step 1106, gameplay can be continued with the second arrangement of playing sections 116 for the second number of players.

In an exemplary embodiment, because the rigid outer frame 102 can remain assembled and deployed during reconfiguration, the transition from the first arrangement to the second arrangement can be performed without rebuilding the court perimeter, thereby preserving game flow while maintaining visually determinable boundaries formed by taut divider cords 114.

Figure 11:
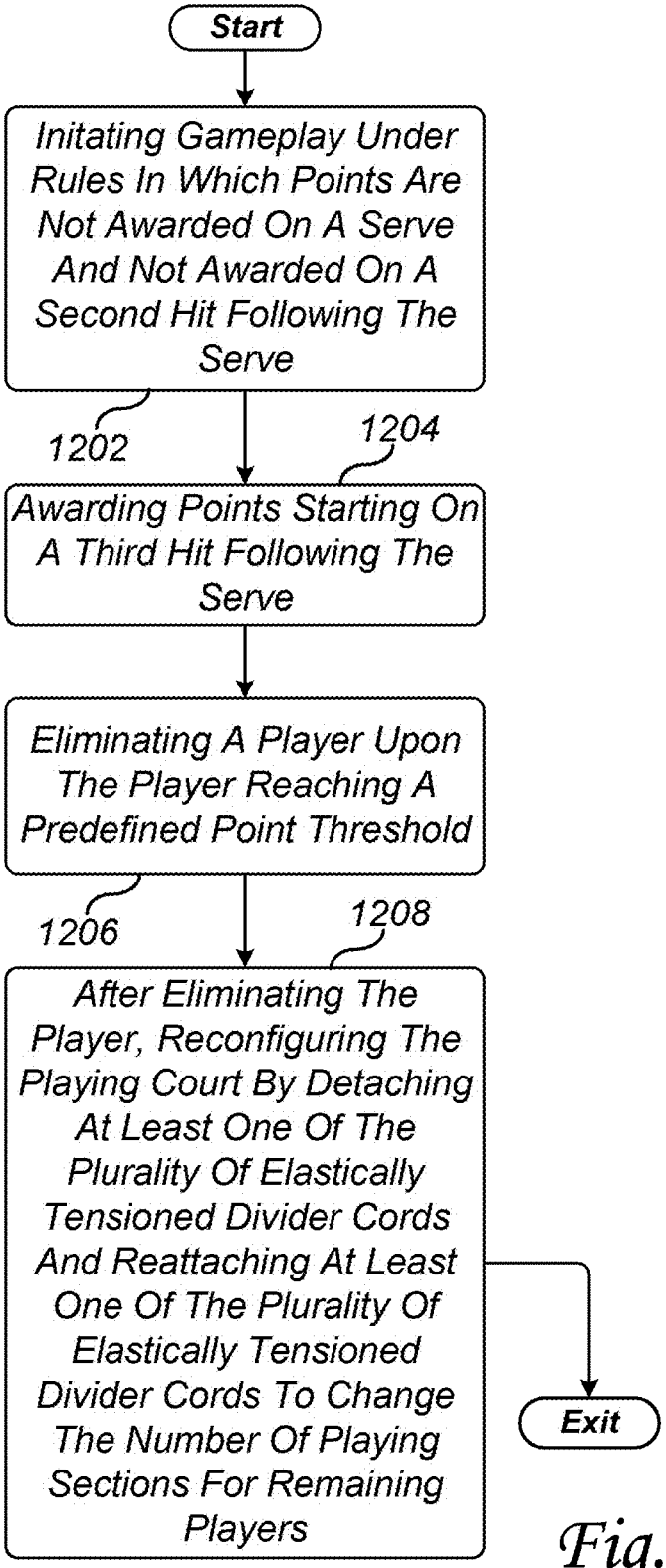

Referring to FIG. 11, there illustrated one example of a gameplay method flowchart in which a points-based elimination condition can trigger in-game reconfiguration of the playing court defined by the reconfigurable paddle ball court system 100.

In step 1202, gameplay can be initiated under rules in which points are not awarded on a serve and are not awarded on a second hit following the serve.

In an exemplary embodiment, this "no-points" portion can operate as a controlled start sequence that places the game ball 122 into active play without immediately triggering scoring consequences, thereby encouraging consistent serve mechanics and reducing disputes about whether an early exchange should count toward a player's score.

In step 1204, points can be awarded starting on a third hit following the serve.

In an exemplary embodiment, by delaying point eligibility until the third hit (and subsequent hits), the gameplay can emphasize rally establishment and controlled ball placement, rather than opportunistic scoring immediately upon initiation, while still preserving clear, repeatable scoring logic that players can apply consistently across playing sections 116.

In step 1206, a player can be eliminated upon the player reaching a predefined point threshold.

In an exemplary embodiment, the predefined point threshold can be selected based on a desired match duration and competitiveness, and can be a fixed threshold (e.g., 11 points) or another selected value.

In an exemplary embodiment, elimination can change the active player count, which can create a technical need for the playing court to be reconfigured so that the remaining active players can continue play with a revised number of playing sections 116.

In step 1208, after eliminating the player, the playing court can be reconfigured by detaching at least one of the plurality of elastically tensioned divider cords 114 and reattaching at least one of the plurality of elastically tensioned divider cords 114 to change the number of playing sections for remaining players.

In an exemplary embodiment, detaching and reattaching can include changing a hub-side connection at the inner hub 110 (e.g., by moving a first end of a divider cord 114 to a different hub attachment location) and changing a perimeter connection at a different position along the rigid outer frame 102, such that the divider cords 114 remain elastically tensioned and continue to provide visually determinable internal boundaries during continued play.

The flow diagrams depicted herein are just examples. There may be many variations to these diagrams or the steps (or operations) described therein without departing from the spirit of the invention. For instance, the steps may be performed in a different order, or steps may be added, deleted, or modified. All of these variations are considered a part of the claimed invention.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A reconfigurable paddle ball court system configured to define a plurality of playing sections for a multiplayer paddle-and-ball game, the reconfigurable paddle ball court system comprising:

a rigid outer frame configured, when assembled, to define a closed-loop outer boundary of a playing court, the rigid outer frame comprising a tubular or rod perimeter member;

an inner hub disposed within the closed-loop outer boundary, the inner hub comprising a flexible sheet material configured to be placed on a playing surface;

a plurality of inner fasteners coupled to the inner hub and distributed about a perimeter region of the inner hub at discrete hub attachment locations; and a plurality of divider cords, each divider cord comprising an elastic cord portion, a first end comprising a cord fastener removably coupleable to any selected one of the plurality of inner fasteners, and a second end comprising a cord clip configured to removably snap around an exterior surface of the tubular or rod perimeter member of the rigid outer frame at a selectable attachment location along the rigid outer frame;

a plurality of friction marker structures disposed on the rigid outer frame at discrete perimeter attachment locations, each of the plurality of friction marker structures comprising at least one of a tape segment, a textured coating, an elastomeric sleeve, an overmolded patch, or a knurled region;

wherein each cord clip is configured to seat on or against a selected one of the plurality of friction marker structures such that the selected one of the plurality of friction marker structures both (i) inhibits circumferential migration of the cord clip along the rigid outer frame under tension applied by a corresponding one of the plurality of divider cords and (ii) identifies an indexed perimeter attachment location for repeatable placement of the corresponding one of the plurality of divider cords;

wherein each divider cord is structurally relocatable between (i) a first attachment configuration in which the cord fastener is coupled to a first selected one of the plurality of inner fasteners and the cord clip is seated on or against a first selected one of the plurality of friction marker structures, and (ii) a second attachment configuration in which the cord fastener is coupled to a second selected one of the plurality of inner fasteners and the cord clip is seated on or against a second selected one of the plurality of friction marker structures;

wherein, in each of the first attachment configuration and the second attachment configuration, the elastic cord portion is stretched between the inner hub and the rigid outer frame so that the corresponding divider cord is maintained taut as a boundary segment of the plurality of playing sections; and wherein relocation of at least one divider cord from the first attachment configuration to the second attachment configuration changes at least one of (a) a number of the plurality of playing sections and (b) a size of at least one playing section, while the rigid outer frame remains assembled and deployed.

2. The reconfigurable paddle ball court system of claim 1, wherein the tubular or rod perimeter member comprises a plurality of frame segments removably coupled together to form the closed-loop outer boundary.

3. The reconfigurable paddle ball court system of claim 1, wherein the plurality of inner fasteners comprises at least eight inner fasteners distributed about the perimeter region of the inner hub at angularly spaced hub attachment locations, each of the at least eight inner fasteners being configured to removably couple to the cord fastener of a corresponding one of the plurality of divider cords.

4. The reconfigurable paddle ball court system of claim 1, wherein the elastic cord portion is configured to maintain the divider cord taut when the cord clip is seated on or against different ones of the plurality of friction marker structures.

5. The reconfigurable paddle ball court system of claim 1, wherein the cord clip comprises a resilient clip body having an open-sided frame-receiving channel sized to receive the tubular or rod perimeter member in snap-fit engagement.

6. The reconfigurable paddle ball court system of claim 1, further comprising a kit that includes a carrying bag, a plurality of paddles, and at least one game ball, wherein the rigid outer frame comprises a plurality of removable frame segments, and wherein the carrying bag is configured to receive the plurality of removable frame segments, the inner hub, the plurality of divider cords, the plurality of paddles, and the at least one game ball for transport.

7. A method of using the reconfigurable paddle ball court system of claim 1, the method comprising:

coupling the plurality of divider cords between the inner hub and the rigid outer frame to define a first number of the playing sections;

maintaining the rigid outer frame in an assembled and deployed condition while the plurality of divider cords define the first number of the playing sections;

changing the first number of the playing sections to a second number of the playing sections by detaching at least one divider cord from a first selected one of the plurality of inner fasteners and from a first selected one of the plurality of friction marker structures, and reattaching the at least one divider cord to a second selected one of the plurality of inner fasteners and to a second selected one of the plurality of friction marker structures, wherein the second number of the playing sections is different than the first number of the playing sections; and maintaining the rigid outer frame in the assembled and deployed condition while the plurality of divider cords define the second number of the playing sections.

8. A reconfigurable paddle ball court system configured to define a plurality of playing sections for a multiplayer paddle-and-ball game, the reconfigurable paddle ball court system comprising:

a rigid outer frame defining an outer perimeter boundary of a playing court when assembled, the rigid outer frame comprising a tubular or rod perimeter member;

an inner hub positioned within the rigid outer frame;

a plurality of divider cords, each extending between the inner hub and the rigid outer frame;

a plurality of friction marker structures disposed on the tubular or rod perimeter member at discrete perimeter attachment locations, each of the plurality of friction marker structures comprising at least one of a tape segment, a textured coating, an elastomeric sleeve, an overmolded patch, or a knurled region;

wherein each of the plurality of divider cords comprises (i) an inner-end connector configured to removably couple to the inner hub at one of a plurality of discrete hub attachment locations, and (ii) an outer-end connector comprising a snap clip configured to removably engage the rigid outer frame at any of a plurality of selectable positions along the rigid outer frame by snap-fit engagement around the tubular or rod perimeter member, and wherein each snap clip is configured to seat on or against a selected one of the plurality of friction marker structures such that the selected one of the plurality of friction marker structures both (i) inhibits sliding of the snap clip along the rigid outer frame under tension applied by a corresponding one of the plurality of divider cords and (ii) identifies an indexed perimeter attachment location for repeatable placement of the corresponding one of the plurality of divider cords; and wherein each of the plurality of divider cords is elastically tensioned between the inner hub and the rigid outer frame to reduce distortion of boundary geometry while the plurality of divider cords define the plurality of playing sections and to facilitate determination of in-bounds and out-of-bounds conditions for the multiplayer paddle-and-ball game.

9. The reconfigurable paddle ball court system of claim 8, wherein the snap clip comprises a resilient clip body having an open-sided frame-receiving channel sized to receive a tubular portion of the rigid outer frame to produce the snap-fit engagement.

10. The reconfigurable paddle ball court system of claim 8, wherein each selected one of the plurality of friction marker structures comprises an elastomeric sleeve disposed around the tubular or rod perimeter member, wherein the snap clip compressively engages the elastomeric sleeve when the corresponding one of the plurality of divider cords is elastically tensioned, and wherein the elastomeric sleeve is visually distinguishable from an adjacent exposed portion of the tubular or rod perimeter member to identify the indexed perimeter attachment location.

11. The reconfigurable paddle ball court system of claim 8, wherein the plurality of discrete hub attachment locations comprises a plurality of inner fasteners coupled to the inner hub and disposed about a perimeter region of the inner hub, each of the plurality of inner fasteners being configured to removably couple to the inner-end connector of a corresponding one of the plurality of divider cords.

12. The reconfigurable paddle ball court system of claim 11, wherein the plurality of inner fasteners comprises at least twelve inner fasteners;

wherein twelve of the plurality of inner fasteners are spaced at thirty-degree arc increments around the perimeter region of the inner hub;

wherein thirty-six of the plurality of friction marker structures are spaced around the rigid outer frame at ten-degree arc increments; and wherein, for each thirty-degree arc increment between adjacent ones of the twelve inner fasteners, the thirty-six friction marker structures include three of the indexed perimeter attachment locations.

13. The reconfigurable paddle ball court system of claim 8, wherein each of the plurality of divider cords is configured such that, when tensioned between the inner hub and the rigid outer frame, each of the plurality of divider cords defines a boundary segment that extends from the inner hub toward the rigid outer frame without crossing a center of the playing court, and wherein the plurality of divider cords define non-intersecting boundary segments between adjacent ones of the plurality of playing sections.

14. The reconfigurable paddle ball court system of claim 8, further comprising a kit including a carrying bag configured to receive the rigid outer frame, the inner hub, the plurality of divider cords, a plurality of paddles, and at least one game ball for transport, wherein the rigid outer frame comprises a plurality of removable frame segments carrying the plurality of friction marker structures, and wherein the carrying bag comprises one or more internal compartments configured to separate the plurality of divider cords from the plurality of removable frame segments during transport.

15. A method of using the reconfigurable paddle ball court system of claim 8, the method comprising:

configuring the reconfigurable paddle ball court system with a first set of the plurality of divider cords to define a first arrangement of the playing sections 4 for a first number of players;

while the rigid outer frame remains assembled and deployed, reconfiguring the reconfigurable paddle ball court system from the first arrangement to a second arrangement by moving at least one of the plurality of divider cords to a different hub attachment location and moving the corresponding snap clip of the at least one of the plurality of divider cords to a different one of the plurality of friction marker structures disposed on the rigid outer frame to define the second arrangement of the playing sections for a second number of players; and maintaining the plurality of divider cords elastically tensioned between the inner hub and the rigid outer frame in the second arrangement.

16. A reconfigurable paddle ball court system configured to define a plurality of playing sections for a multiplayer paddle-and-ball game, the reconfigurable paddle ball court system comprising:

a rigid outer frame configured to define an outer boundary of a playing court when assembled, the rigid outer frame comprising a tubular or rod perimeter member;

an inner hub disposed within the outer boundary;

a plurality of inner fasteners disposed about a perimeter region of the inner hub;

a plurality of elastically tensioned divider cords, each of the plurality of elastically tensioned divider cords having a first end removably coupleable to any selected inner fastener and a second end removably coupleable to the rigid outer frame at a selectable position along the rigid outer frame, the second end comprising a cord clip configured to removably snap around an exterior surface of the tubular or rod perimeter member; and a plurality of friction marker structures disposed on the rigid outer frame at discrete perimeter attachment locations, each of the plurality of friction marker structures comprising at least one of a tape segment, a textured coating, an elastomeric sleeve, an overmolded patch, or a knurled region;

wherein the plurality of inner fasteners and the plurality of friction marker structures define a plurality of predefined attachment sets, each predefined attachment set identifying (i) selected ones of the plurality of inner fasteners and (ii) selected ones of the plurality of friction marker structures for coupling 23 a corresponding set of the plurality of elastically tensioned divider cords to define a corresponding playing-section arrangement;

wherein the plurality of predefined attachment sets comprises a first predefined attachment set corresponding to a first playing-section arrangement having a first number of the plurality of playing sections and a second predefined attachment set corresponding to a second playing-section arrangement having a second number of the plurality of playing sections different from the first number;

wherein the plurality of elastically tensioned divider cords are configured to define the plurality of playing sections arranged about the inner hub and to remain taut when coupled according to any selected one of the plurality of predefined attachment sets, and wherein the system is configured to be reconfigured by relocating at least one of the plurality of elastically tensioned divider cords from the first predefined attachment set to the second predefined attachment set to change at least one of (a) a number of the plurality of playing sections and (b) a relative size of the plurality of playing sections without disassembling the rigid outer frame.

17. The reconfigurable paddle ball court system of claim 16, wherein the first predefined attachment set corresponds to a four-player playing-section arrangement, wherein the second predefined attachment set corresponds to a three-player playing-section arrangement, and wherein the plurality of friction marker structures comprises first visual indicia disposed on first ones of the plurality of friction marker structures identifying the first predefined attachment set and second visual indicia disposed on second ones of the plurality of friction marker structures identifying the second predefined attachment set.

18. The reconfigurable paddle ball court system of claim 16, wherein the plurality of predefined attachment sets further comprises a third predefined attachment set corresponding to a two-player playing-section arrangement, and third visual indicia disposed on third ones of the plurality of friction marker structures identifying the third predefined attachment set.

19. The reconfigurable paddle ball court system of claim 16, wherein at least one of the plurality of predefined attachment sets defines unequal playing sections having different areas, and wherein the at least one predefined attachment set includes unequal angular spacing between at least two adjacent divider cords.

20. A method of using the reconfigurable paddle ball court system of claim 16, the method comprising:

configuring the plurality of elastically tensioned divider cords in the first playing-section arrangement that defines the first number of the plurality of playing sections;

selecting the second playing-section arrangement such that the second number of the plurality of playing sections is less than the first number of the plurality of playing sections;

after selecting the second playing-section arrangement, physically reconfiguring the playing court by detaching at least one of the plurality of elastically tensioned divider cords from the rigid outer frame and from one of the plurality of inner fasteners;

reattaching the at least one of the plurality of elastically tensioned divider cords to a different one of the plurality of inner fasteners and to a different selectable position along the rigid outer frame while the rigid outer frame remains assembled and deployed; and maintaining the at least one of the plurality of elastically tensioned divider cords taut in the second playing-section arrangement.

* * * * *